US009113259B2

(12) United States Patent
Pan

(10) Patent No.: US 9,113,259 B2
(45) Date of Patent: Aug. 18, 2015

(54) TUNABLE MULTICHANNEL HEADPHONE AND METHOD FOR ASSEMBLING THE SAME

(71) Applicant: OBO PRO.2 INC., Taoyuan City, Taoyuan County (TW)

(72) Inventor: Chien-Chuan Pan, New Taipei (TW)

(73) Assignees: Chien-Chuan Pan, New Taipei (TW); OBO PRO.2 INC., Taoyuan (TW)

( * ) Notice: Subject to any disclaimer, the term of this patent is extended or adjusted under 35 U.S.C. 154(b) by 266 days.

(21) Appl. No.: 13/626,049

(22) Filed: Sep. 25, 2012

(65) Prior Publication Data

US 2013/0077800 A1 Mar. 28, 2013

(30) Foreign Application Priority Data

Sep. 26, 2011 (TW) ..... 100134546 A

(51) Int. Cl.

| | |
|---|---|
| ***H04R 1/28*** | (2006.01) |
| ***H04S 3/00*** | (2006.01) |
| *H04R 1/10* | (2006.01) |
| *H04R 1/26* | (2006.01) |
| *H04R 5/033* | (2006.01) |

(52) U.S. Cl.

CPC ..... *H04R 1/2811* (2013.01); *H04S 3/004* (2013.01); *H04R 1/1008* (2013.01); *H04R 1/1041* (2013.01); *H04R 1/26* (2013.01); *H04R 5/033* (2013.01); *Y10T 29/4957* (2015.01)

(58) Field of Classification Search

CPC .. H04R 2420/07; H04R 1/1041; H04R 5/033; H04R 381/74; H04R 381/31; H04R 381/311; H04R 381/58; H04R 1/1016; H04R 1/1066; H04R 1/1008; H04R 381/38; H04R 381/37; H04R 1/1083; H04R 381/309

USPC ..... 381/74

See application file for complete search history.

(56) References Cited

U.S. PATENT DOCUMENTS

| | | | | |
|---|---|---|---|---|
| 5,018,599 | A * | 5/1991 | Dohi et al. | 181/129 |
| 5,555,554 | A * | 9/1996 | Hofer et al. | 381/371 |
| 5,729,605 | A * | 3/1998 | Bobisuthi et al. | 379/430 |
| 8,098,872 | B2 * | 1/2012 | Chang | 381/371 |
| 8,311,257 | B2 * | 11/2012 | Hu | 381/367 |
| 2003/0103637 | A1 * | 6/2003 | Huang | 381/309 |

(Continued)

FOREIGN PATENT DOCUMENTS

TW 536096 6/2003

*Primary Examiner* — Fan Tsang
*Assistant Examiner* — Angelica M McKinney
(74) *Attorney, Agent, or Firm* — Alan D. Kamrath; Kamrath IP Lawfirm, P.A.

(57) ABSTRACT

A tunable multichannel headphone includes at least two main housings connected by a connection portion. Each of the main housings includes a speaker disk defining independent sound chambers, a driver unit disposed in the sound chambers, a front acoustic unit and a rear acoustic unit. The front and rear acoustic units are disposed on the opposite sides of the speaker disk. The front acoustic unit has a sound effect tuning unit which has field and channel switches and an audio output unit. The rear acoustic unit has first and second timbre switches. The switches are rotatable members arranged on the speaker disk for tuning different sound effects and tones. A method for assembling the tunable multichannel headphone is also disclosed.

14 Claims, 21 Drawing Sheets

(56) References Cited

U.S. PATENT DOCUMENTS

| | | | | |
|---|---|---|---|---|
| 2004/0218775 | A1* | 11/2004 | Huang | 381/371 |
| 2006/0159279 | A1* | 7/2006 | Kuo et al. | 381/74 |
| 2009/0232340 | A1* | 9/2009 | Yang | 381/371 |
| 2012/0099755 | A1* | 4/2012 | Hu | 381/380 |
| 2012/0114160 | A1* | 5/2012 | Lin | 381/380 |
| 2012/0163616 | A1* | 6/2012 | Birch | 381/74 |
| 2013/0223669 | A1* | 8/2013 | Chen | 381/370 |
| 2014/0133668 | A1* | 5/2014 | Podoloff | 381/74 |

* cited by examiner

TUNABLE MULTICHANNEL HEADPHONE AND METHOD FOR ASSEMBLING THE SAME

BACKGROUND

1. Field of the Invention

The instant disclosure relates to a multichannel headphone, and in particular, to a tunable multichannel headphone which allows for adjusting sound effect and timbre characteristics and the method for assembling the same.

2. Description of Related Art

High fidelity audio equipment is capable of powerful sound reproduction to bring out the ultra pure sound wave. In order to deliver spacious sound, in general, a front speaker, a rear speaker, a subwoofer and a centre speaker are specifically arranged to achieve the surround effect. The speakers have to be spaced by a predetermined distance, thus requiring a spacious room to accommodate the audio equipment.

However, a well-designed audio room, high-end speakers and accessories may not be available to everyone. In addition, without an appropriate soundproofing system, the sound travels and may become noise to others. Under the circumstances, using a headphone to replace the speakers allows a listener to enjoy the audio stream easily and quietly.

Conventional multichannel headphones comprise a headband and two headphone units which connect to either end of the headband respectively. The headband helps to rest the headphone units outside the ears of the listener. Each of the headphone units includes a housing, a low frequency effect (LFE) speaker, a plurality of single-channel chambers and a plurality of single-channel speakers. The single-channel chambers are arranged in the housing, and the single-channel speakers are separately disposed in the single-channel chambers. The housing also accommodates the LFE speaker and is used as a resonation amplifier. Therefore, the two headphone units deliver at least four channels and two LFE channels.

Nevertheless, the surround effect, the lows and the extended highs are not satisfyingly delivered, because the speakers are arranged on the same plane. Different auditory signals, for example, classical music and rock, cannot be differentiated due to the monotonic audio output. In addition, the conventional headphones do not provide a complete enclosure of the speakers resulting in reduced field accuracy because the lack of well defined sound chambers.

The multichannel headphones with the general characteristics described above are known from Patent TW 536096, entitled Multichannel Headphone Module.

SUMMARY OF THE INVENTION

The object of the instant disclosure is to provide a tunable multichannel headphone which enables fields, channels and timbre switching in order to meet different listening requirements.

Another aspect of the instant disclosure is using the switching system to simulate a plurality of sound chambers and to adjust the audio current path, thus providing a surround effect and a four-dimensional listening experience.

Still another aspect of the instant disclosure is using the intricate audio path to direct the audio current and to generate different channel systems (e.g. 2.1, 5.1, 7.1 and 9.1 channel systems) for a distinct sound effect.

Still another aspect of the instant disclosure is using the switching system to concentrate, amplify and bend the audio current and deliver different fields and timbre.

Still another aspect of the instant disclosure is to provide a rich and lossless sound from the headphones. The speaker disk is configured to enhance a beat response, and the main housing accommodates front and rear acoustic modules separately for clear sound transmissions.

Further, another aspect of the instant disclosure is to provide well spaced sound chambers to prevent fields from blending.

Finally, for different listening modes, the front and rear acoustic modules can be either in air communication or not. The independent timbre tuning units are able to provide distinct surround effects and tones.

According to one exemplary embodiment of the instant disclosure, the tunable multichannel headphone comprises two, interconnecting, main housings. Each of the main housings includes a speaker disk, a driver unit, a front acoustic module and a rear acoustic module.

The speaker disk has a cap and a plurality of independent sound chambers. The driver unit has a primary driver and a plurality of secondary drivers lodging into the corresponding sound chambers of the speaker disk.

The front acoustic module has a sound effect tuning unit and an audio output unit. The cap directly contacts the sound effect tuning unit followed by the audio output unit.

The sound effect tuning unit has a channel switch and a field switch which are axially rotatable along the centre of the speaker disk. The rotary switches allow different audio current paths, therefore providing different channel systems and fields.

The rear acoustic module disposed opposite to the front acoustic module on the speaker disk has a timbre tuning unit with a first timbre switch and a second timbre switch which can both axially rotate along the centre of the speaker disk to change tones. The second timbre switch is arranged farthest from the listener's ears.

The instant disclosure also provides a method for assembling the tunable multichannel headphone, comprising, firstly, preparing a speaker disk. Secondly, preparing a primary driver unit and a plurality of secondary driver units which are accommodated in the speaker disk on either end. Thirdly, extending a connector to a locking hole on the outer face of the speaker disk. Furthermore, engaging a fastening member of the main housing to the end of the connector. Finally, screw fastening a front acoustic module to the secondary speakers and a rear acoustic module to the primary speaker. The speaker disk is then divided into a plurality of independent sound chambers to accommodate the primary and secondary speakers separately. A channel switch and a field switch of the front acoustic module can simultaneously or individually rotate to adjust the channels and fields. A first timbre switch and a second timbre switch of the rear acoustic module can also simultaneously or individually rotate to adjust the tones.

In summary, the instant disclosure provides the tunable multichannel headphone and the method for assembly the same. The main housing is divided into a plurality of independent sound chambers to accommodate the primary and secondary speakers separately to deliver clear and accurate sound. Additionally, the channel, the field, and the first and second timbre switches allow a different sound effect combination to cater a variety of audio recordings. For example, the 2.1, 5.1, 7.1 and 9.1 channel systems are available by adjusting the switches to alter the audio current path. The listening experience is a virtually four-dimensional space with a powerful beat response, rich, crisp lows and highs and an exceptional sound reproduction.

In order to further understand the instant disclosure, the following embodiments are provided along with illustrations to facilitate the appreciation of the instant disclosure. However, the appended drawings are merely provided for reference and illustration, without any intention to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
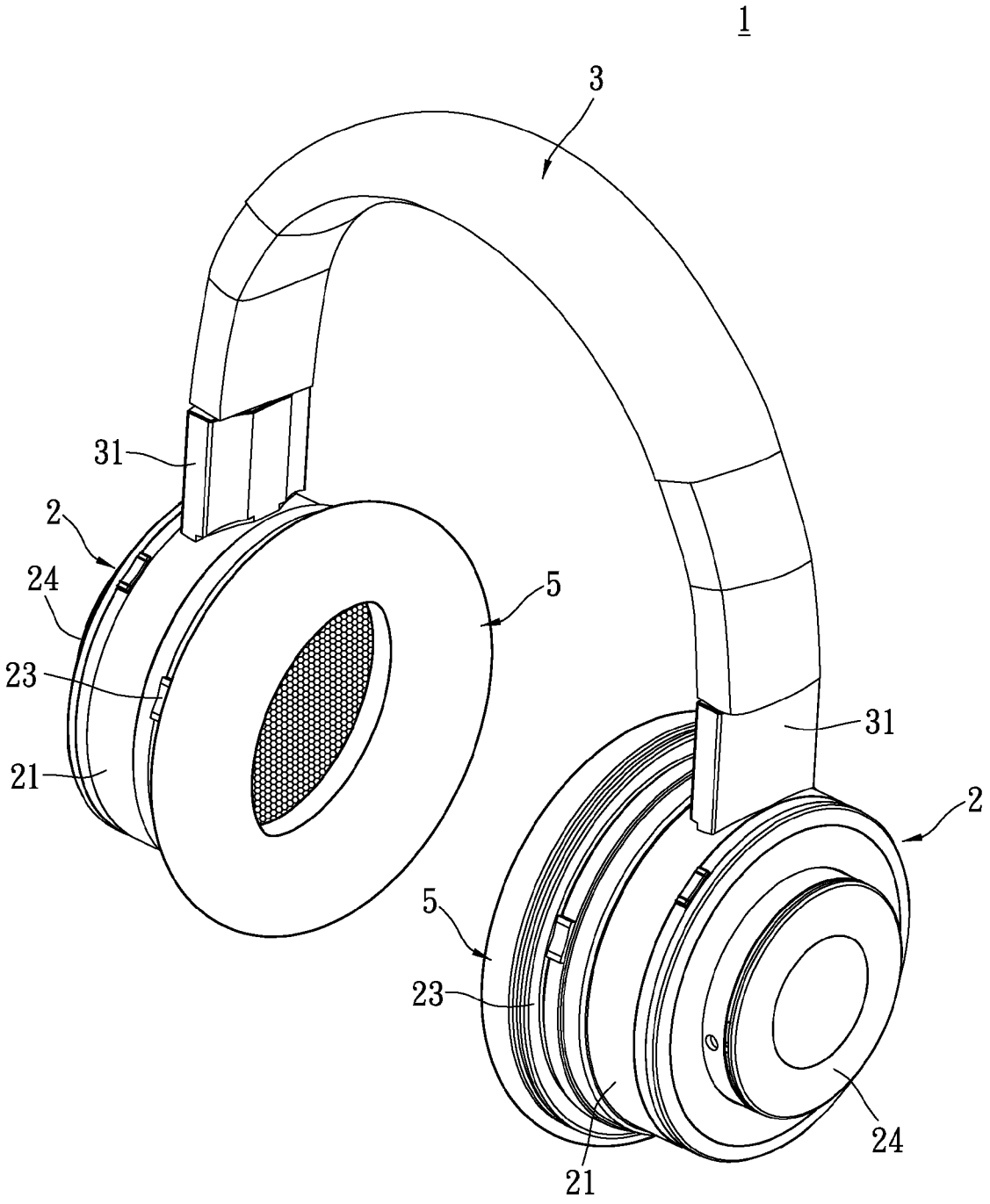
FIG. 1 illustrates a tunable multichannel headphone in accordance with one embodiment of the instant disclosure.

Please refer to FIG. 1. The instant disclosure provides a tunable multichannel headphone 1, which comprises two main housings 2 connected by a connection unit 3. The connection unit 3 includes a plurality of segments (not shown in the figure) for adjusting the length thereof, which is a known technique by the people skilled in the art. In the instant embodiment, the headphone 1 is a substantially symmetrical structure, so the description herein focuses on one half of the headphone 1, which is one of the two main housings 2.

The headphone 1 comprises a plurality of disk members stacked one by one to allow multiple rotations for providing different listening modes.

The headphone 1 provides a listening experience simulating a four-dimensional space. Please refer to FIG. 2 in conjunction with FIG. 1. Specifically, the four-dimensional listening experience is satisfied by a plurality of speakers surrounding a listener and the disk members acting as switches.

Figure 2:
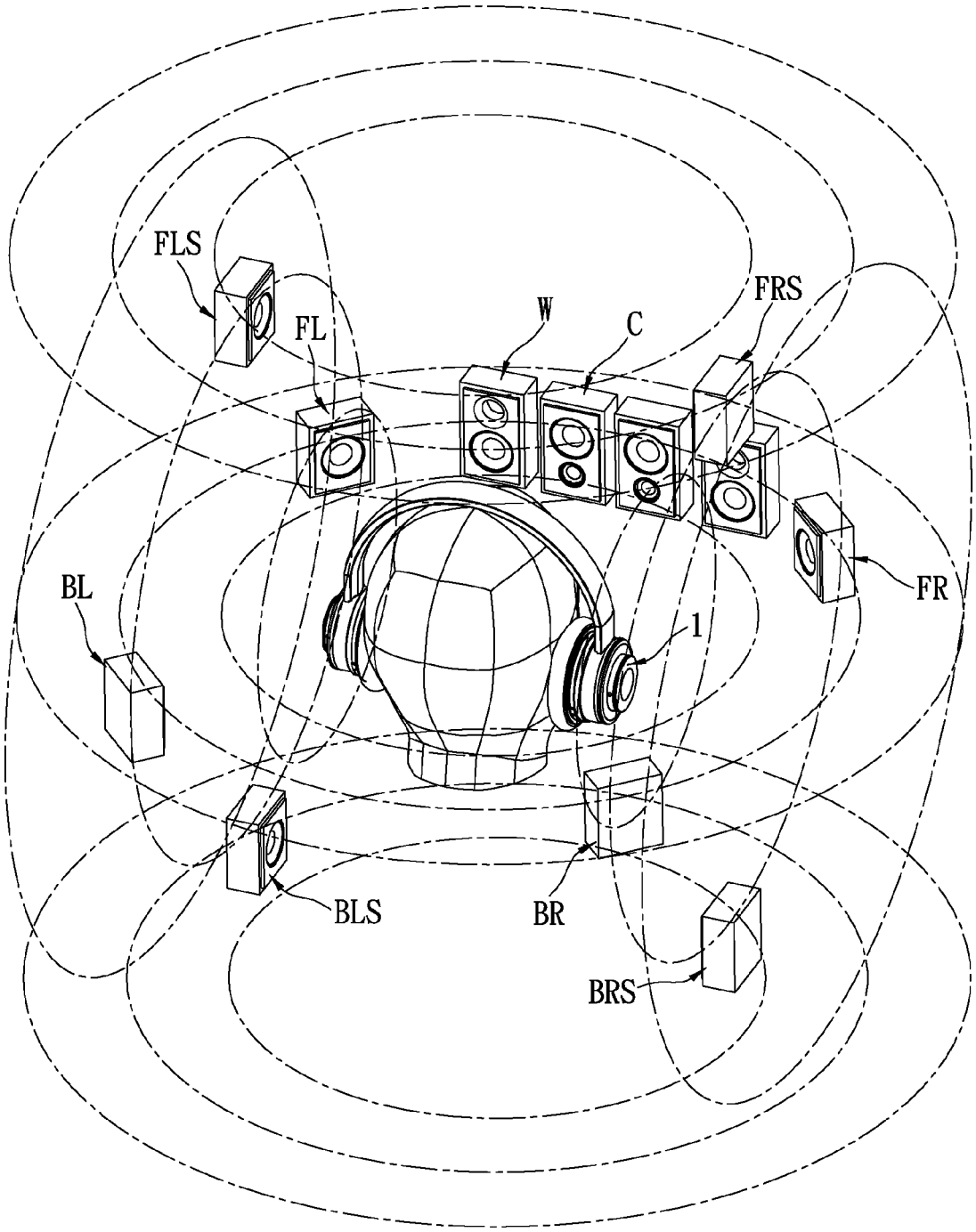
FIG. 2 illustrates a schematic diagram of a virtual speaker arrangement.

For example, FIG. 2 shows a virtual speaker spatial arrangement with a centre speaker C, a subwoofer W, a front left speaker FL, a front right speaker FR, a rear surround left speaker BLS, a rear surround right speaker BRS, a front surround left speaker FLS, a front surround right speaker FRS, a rear left speaker BL and a rear right speaker BR. By tuning the disk members of the headphone 1, the listener receives a surround sound from a spherical radius and has an exceptional sonic performance. In other words, the sound wave completely envelopes the listener to simulate a fourth dimension.

When rotating any one of the disk members, the intricate interior partitions provide various audio current paths, and the sound is delivered in a distinct manner. The tunable switches are described in detail herein.

Figure 3:
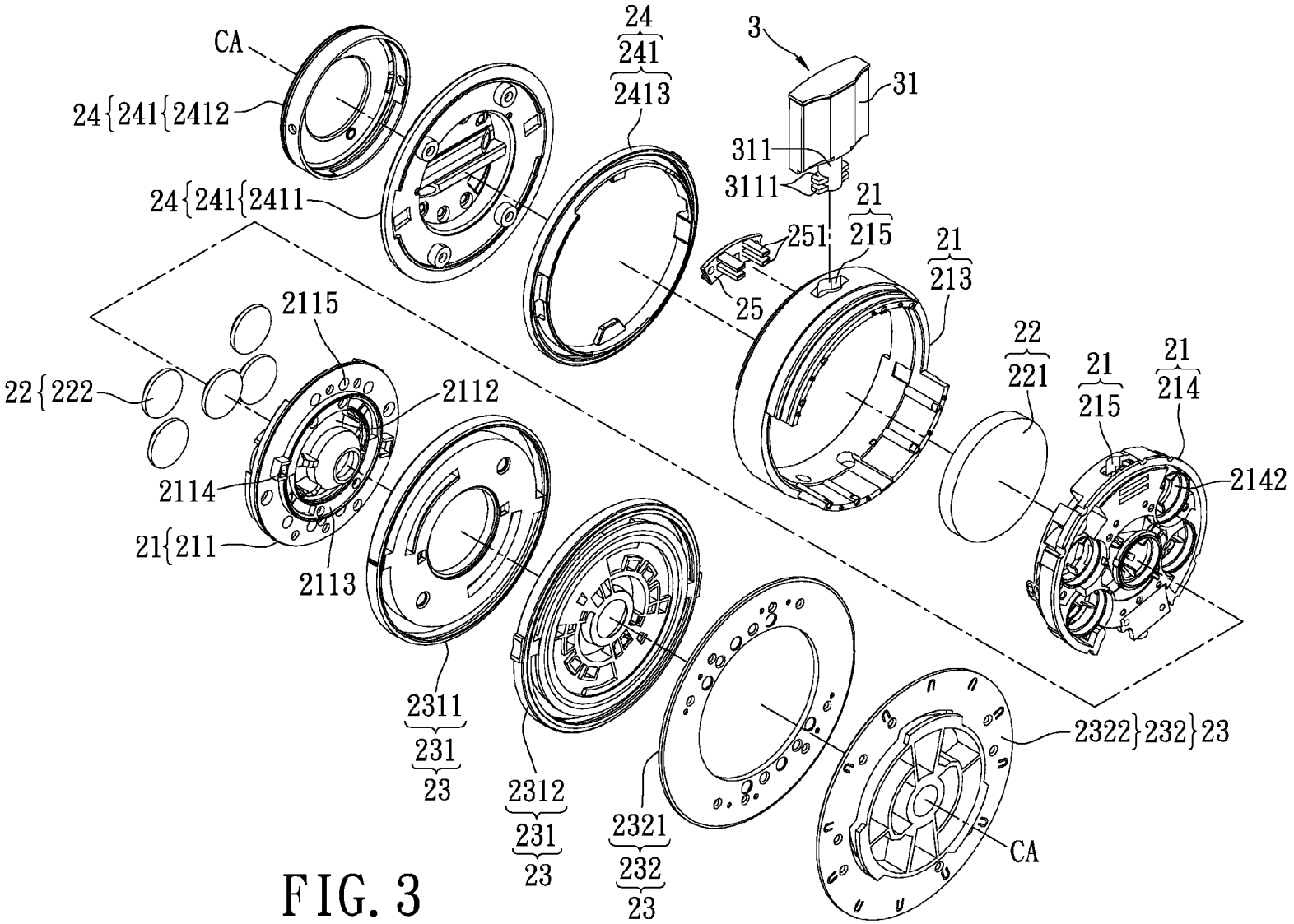
FIG. 3 illustrates an exploded diagram of a tunable multichannel headphone in accordance with one embodiment of the instant disclosure.
Figure 4:
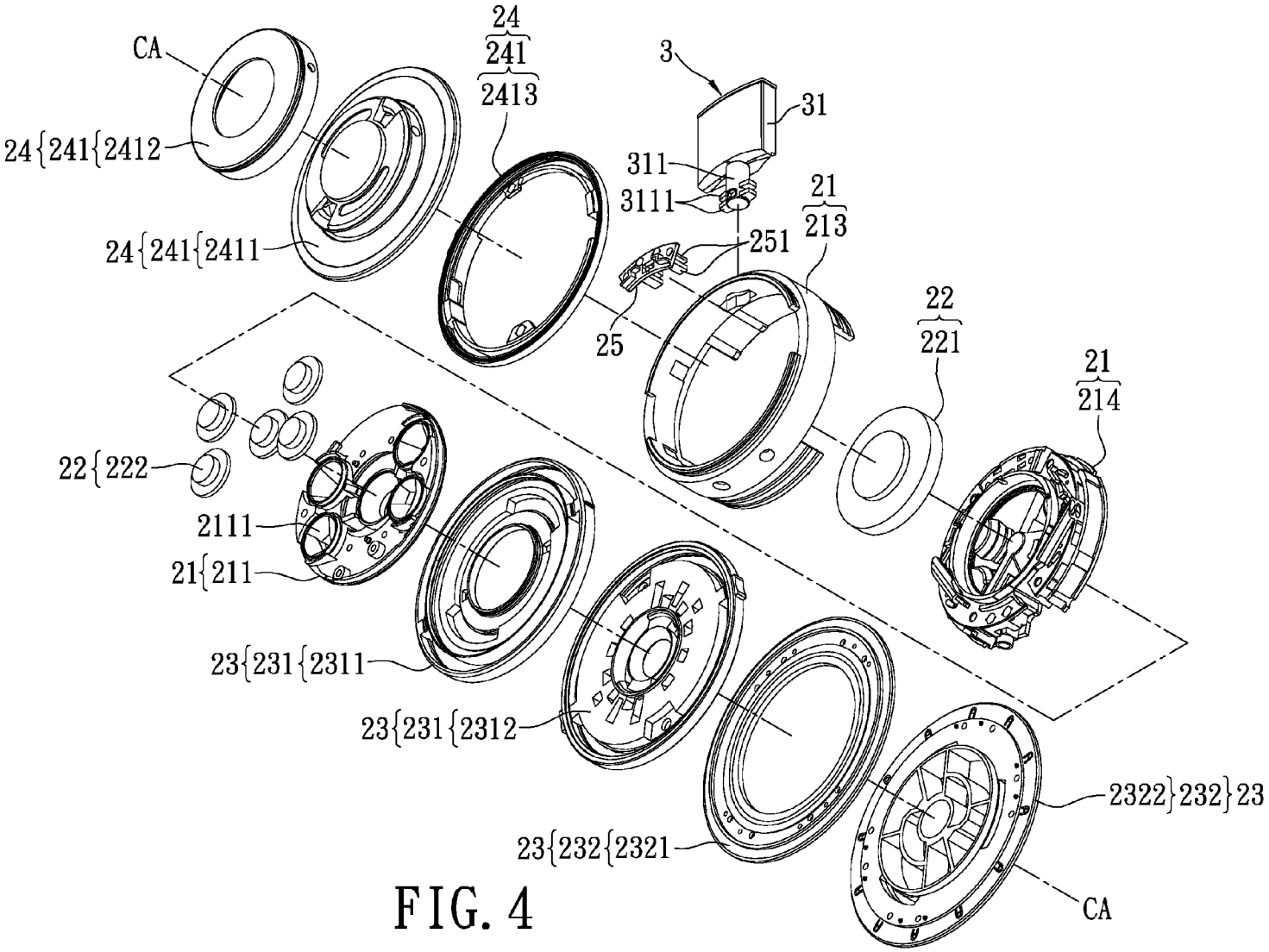
FIG. 4 illustrates an exploded diagram of a tunable multichannel headphone from another view point in accordance with one embodiment of the instant disclosure.

Please refer to FIG. 3 in conjunction with FIG. 4. The main housing 2 comprises a speaker disk 21, a driver unit 22, a front acoustic module 23 and a rear acoustic module 24. The main housing 2 is a chamber further divided by the disk members to accommodate the driver unit 22.

Please refer to FIG. 3. The speaker disk 21 includes a cap 211 and preferably six independent sound chambers (not shown in the figure). The driver unit 22 includes a primary driver 221 and a plurality of secondary drivers 222, preferably five (e.g. front left/right, rear left/right and double bass speakers). The primary and secondary drivers 221, 222 are disposed at opposite sides of the speaker disk 21 in individual sound chambers.

Figure 7:
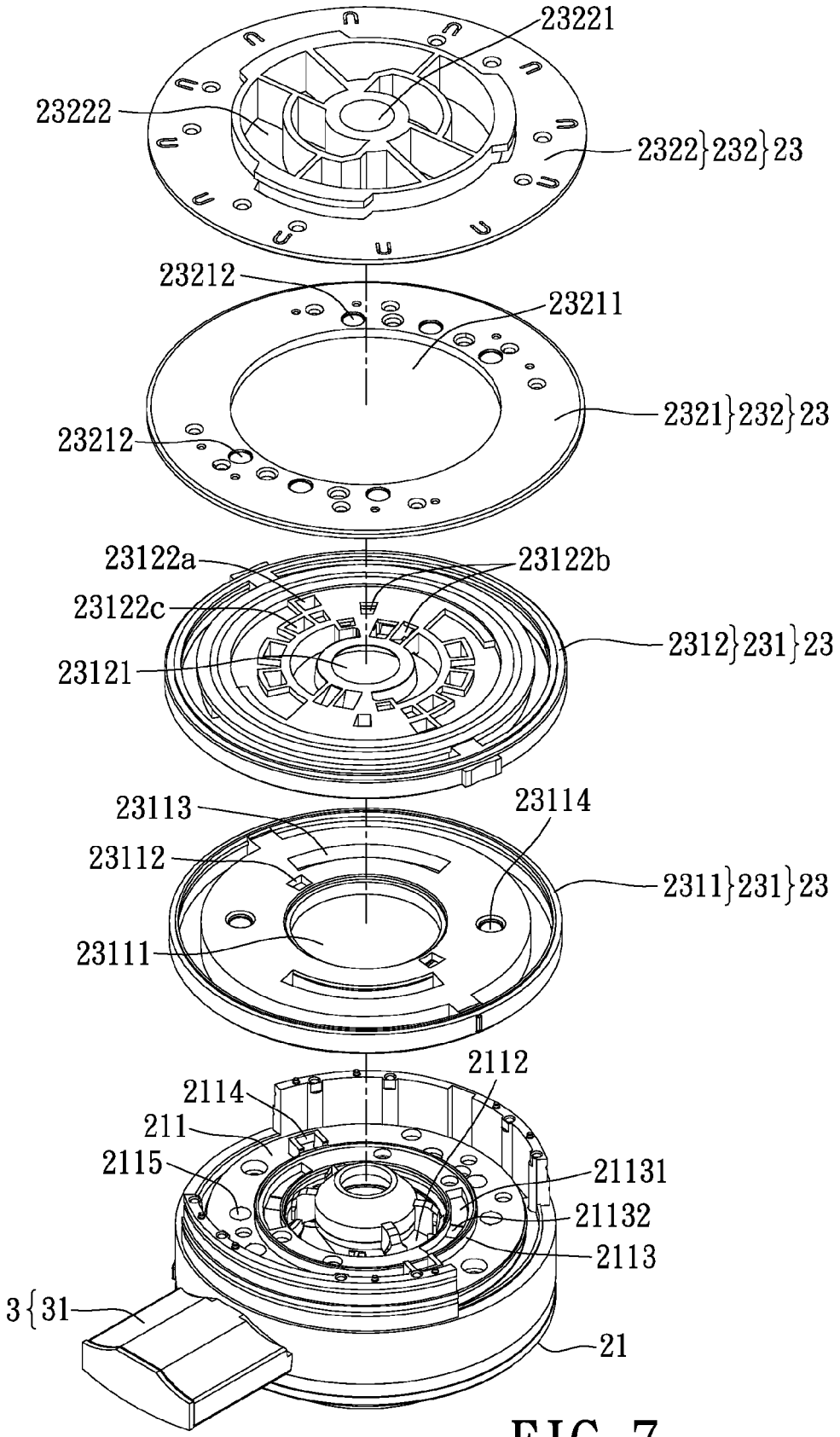
FIG. 7 illustrates an exploded diagram of a front acoustic module of a tunable multichannel headphone in accordance with one embodiment of the instant disclosure.
Figure 8:
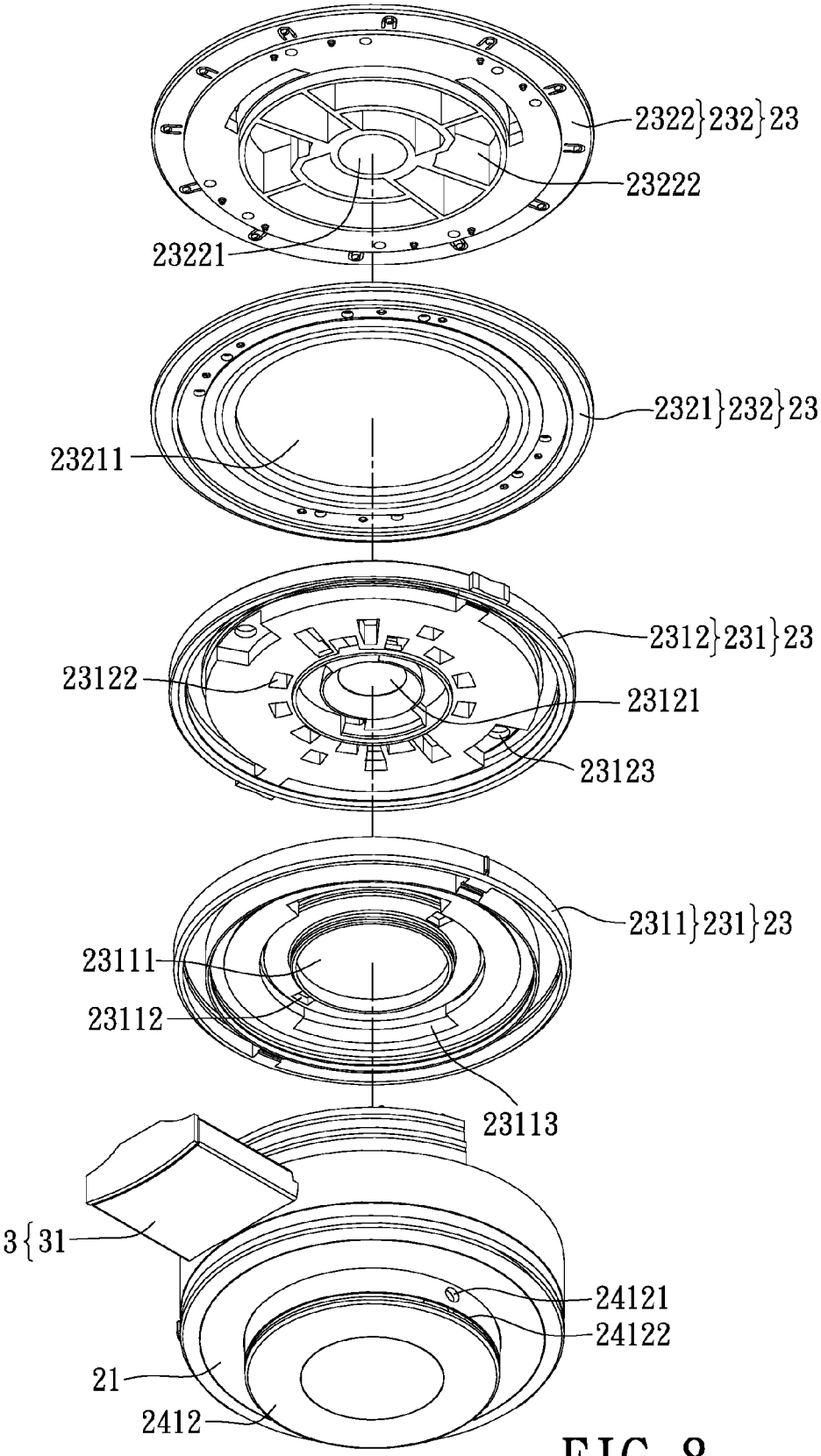
FIG. 8 illustrates an exploded diagram of a front acoustic module of a tunable multichannel headphone from another view point in accordance with one embodiment of the instant disclosure.

Please refer to FIG. 3 in conjunction with FIGS. 7 and 8. The front acoustic module 23 includes a sound effect tuning unit 231 and an audio output unit 232. The disk members are stacked on one another in the order of the cap 211, the sound effect tuning unit 231 and the audio output unit 232.

It is worth noted that the cap 211, the sound effect tuning unit 231 and the audio output unit 232 engage with the speaker disk 21 by screws as well as a plurality of magnets (not shown in the figure). Magnets lodge in the magnet holders for facilitating positioning of each disk member, while a detent engagement (not shown in the figure) can also be used in the instant disclosure exerting the same purpose.

Please refer to FIGS. 11~14. The sound effect tuning unit 231 has a channel switch 2311 and a field switch 2312. The channel switch 2311 has at least one channel detent 23116 and an annular channel engagement groove 23115 held by the channel detent 23116. The field switch 2312 has at least one field detent 23125 and an annular field engagement groove 23124.

The channel and field switches 2311, 2312 can axially rotate along a central axis CA of the speaker disk 21 to adjust a sound effect by different combinations of the independent sound chambers. That is to say, the disk members, which are capable to rotate along the central axis CA (e.g. channel switch 2311 and field switch 2312), allow fine tuning of a sound propagation.

The channel and field switches 2311, 2312 rotate independently without interfering each other and have a plurality of magnet holders 23114, 23123 respectively. The neighboring magnets on the same switch are well spaced to prevent intra magnetic attraction which may cause difficulty in rotation.

Additionally, in the instant embodiment, the channel switch 2311 has three legs for 5.1, 7.1 and 9.1 channel systems. Please refer back to FIG. 1. The leg of the 5.1 channel system is proximate to the connection unit 3, whereas the 7.1 and 9.1 channel systems are further apart thereto.

The field switch 2312 also has three legs: large, medium and small fields. The large field is next to the connection unit 3, and the medium and small fields are relatively apart thereto. The listener can tune the switches for distinct delivering modes. When the channel switch 2311 is tuned to the 5.1 channel system and the field switch is at a small field, the headphone 1 funnels the sound and automatically delivers the wave by the 2.1 channel system.

Figure 9:
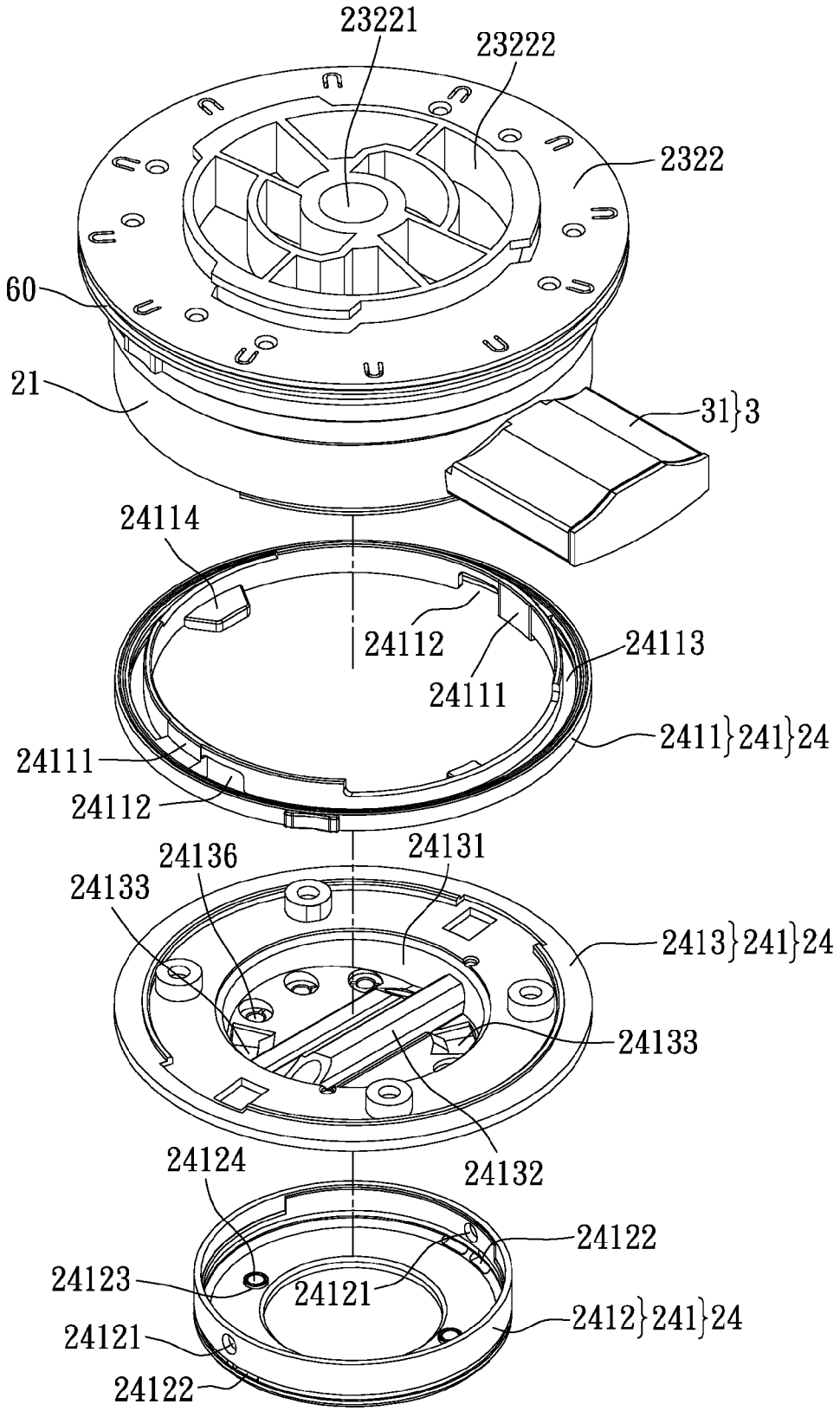
FIG. 9 illustrates an exploded diagram of a rear acoustic module of a tunable multichannel headphone in accordance with one embodiment of the instant disclosure.
Figure 10:
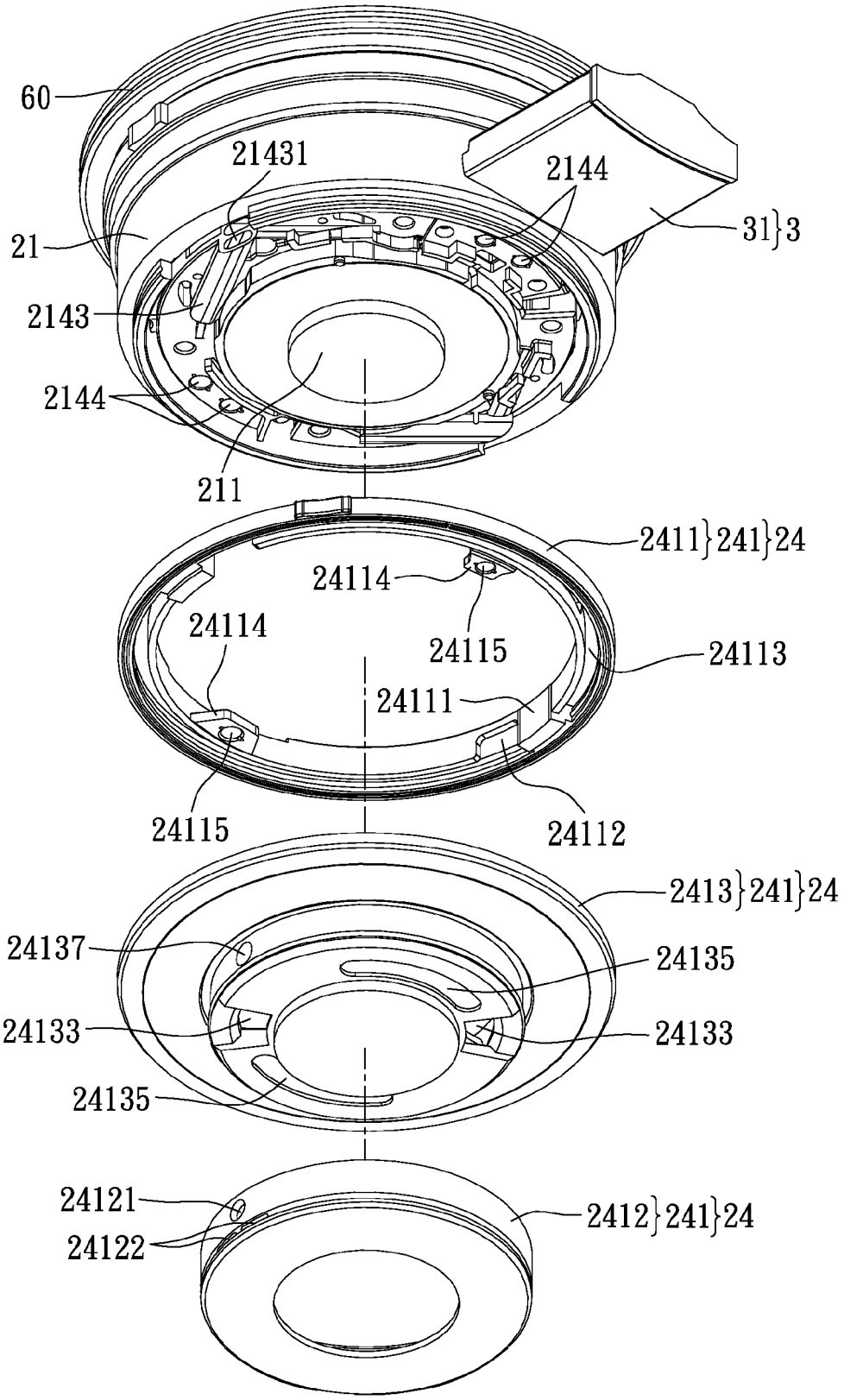
FIG. 10 illustrates an exploded diagram of a rear acoustic module of a tunable multichannel headphone from another view point in accordance with one embodiment of the instant disclosure.

Please refer to FIG. 3 in conjunction with FIGS. 9 and 10. The rear acoustic module 24 is arranged on the speaker disk 21 opposite to the front acoustic module 23.

The rear acoustic module 24 includes a timbre tuning unit 241. The timbre tuning unit 241 has a first timbre switch 2411 and a second timbre switch 2412 which are independently rotatable. A plurality of magnet holders 24115, 24124 are arranged on the first and second timbre switches 2411, 2412 respectively. The magnets in the magnet holders 24115 (not shown in the figure) are arranged in a magnetically repulsive manner, and the same applies to the magnets in the magnet holder 24124.

The second timbre switch 2412 is like a donut in structure and is the farthest from the listener's ears. The first and second timbre switches 2411, 2412 can rotate along the central axis CA of the speaker disk 21 to change the tones; for example, a deep bass or a double deep bass response.

Figure 5:
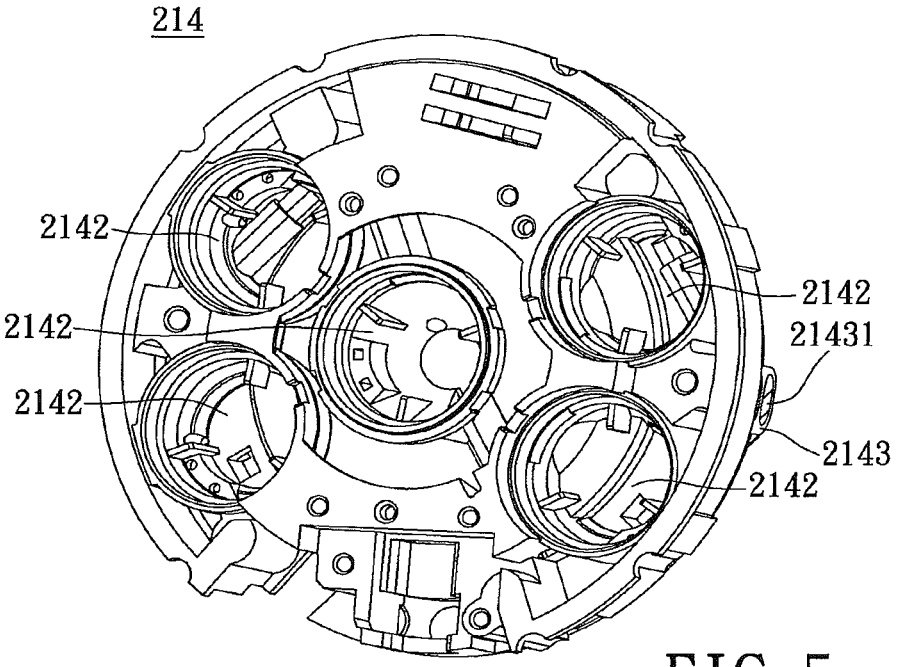
FIG. 5 illustrates a perspective view of a spacer of a tunable multichannel headphone in accordance with one embodiment of the instant disclosure.
Figure 6:
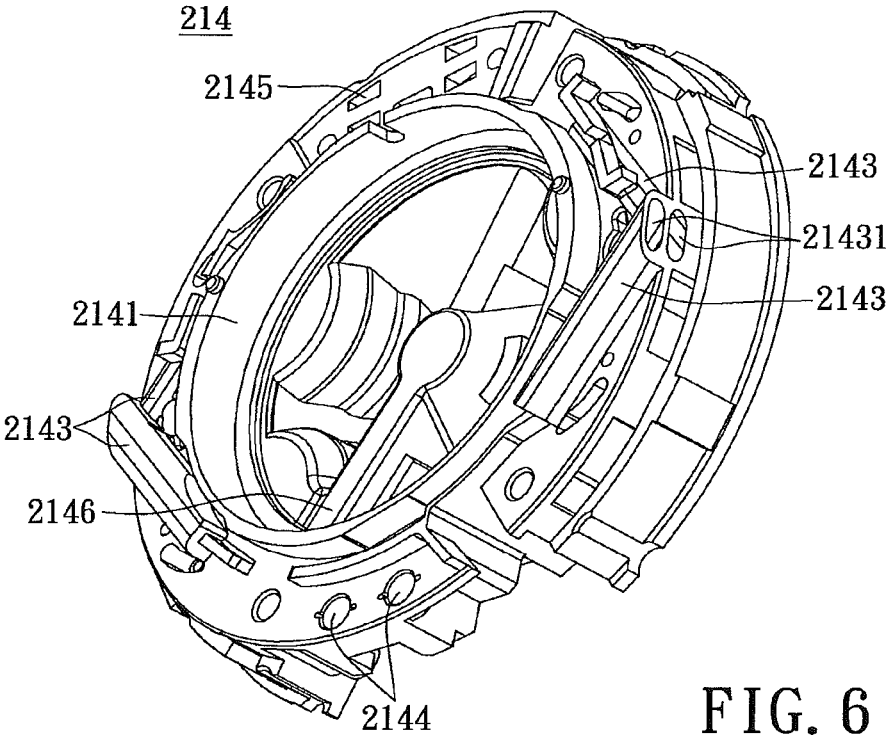
FIG. 6 illustrates a perspective view of a spacer of a tunable multichannel headphone from another view point in accordance with one embodiment of the instant disclosure.

Please refer to FIGS. 3, 5 and 6. The speaker disk 21 includes an outer ring 213 and a spacer 214 which is surrounded by the outer ring 213. The outer ring 213 is preferably annular, and the structure thereof is not limited thereto. The outer ring 213 rests conformingly in the channel engagement groove 23115 and engages with the periphery of the channel switch 2311, thus allowing rotation. Similarly, the other edge of the outer ring 213 rests conformingly in the field engagement groove 23124 to allow mobility of the field switch 2312.

The spacer 214 is formed with an opening 2141 and has five driver holders 2142. The primary driver 221 fits into the opening 2141, whereas the secondary drivers 222 are disposed in the driver holders 2142 respectively. The driver holders 2142 are tapered with close ends, and the secondary drivers 222 tightly engage therewith. Hence, the sound is concentrated by the closed driver holders 2142, while each sound chamber is well spaced.

Please refer to FIG. 5 in conjunction with FIG. 6. The spacer 214 has a plurality of secondary sound ducts 2143 piled one over another.

Each of the secondary sound ducts 2143 has one duct opening 21431. The duct openings 21431 can be arranged toward a different direction, for example, facing the secondary drivers 222 or the opening 2141. The tails of the secondary sound ducts 2143 are substantially aligned with the edge of the spacer 214. In addition, the spacer 214 has four magnet holders 2144 substantially symmetrically disposed. The magnets (not shown in the figure) are disposed in a magnetic repulsion manner in the magnet holders 2144. The members of the rear acoustic module 24 are described herein.

Please refer to FIGS. 3, 9 and 10. The first timbre switch 2411 is ring shaped with two inner shields 24111 which are substantially opposite one another.

Figure 21:
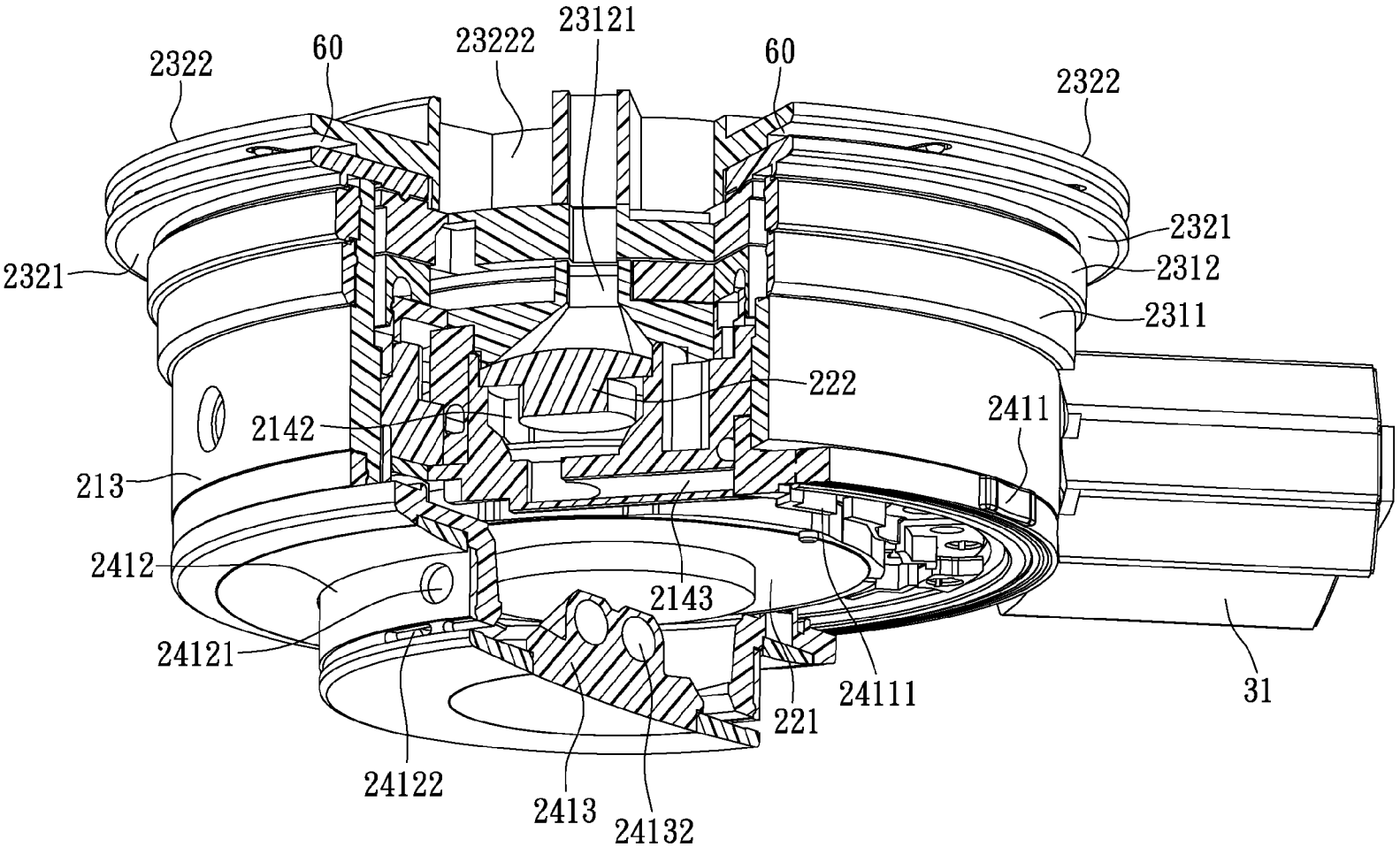
FIG. 21 illustrates a fourth cross-sectional view of a tunable multichannel headphone in accordance with one embodiment of the instant disclosure.
Figure 22:
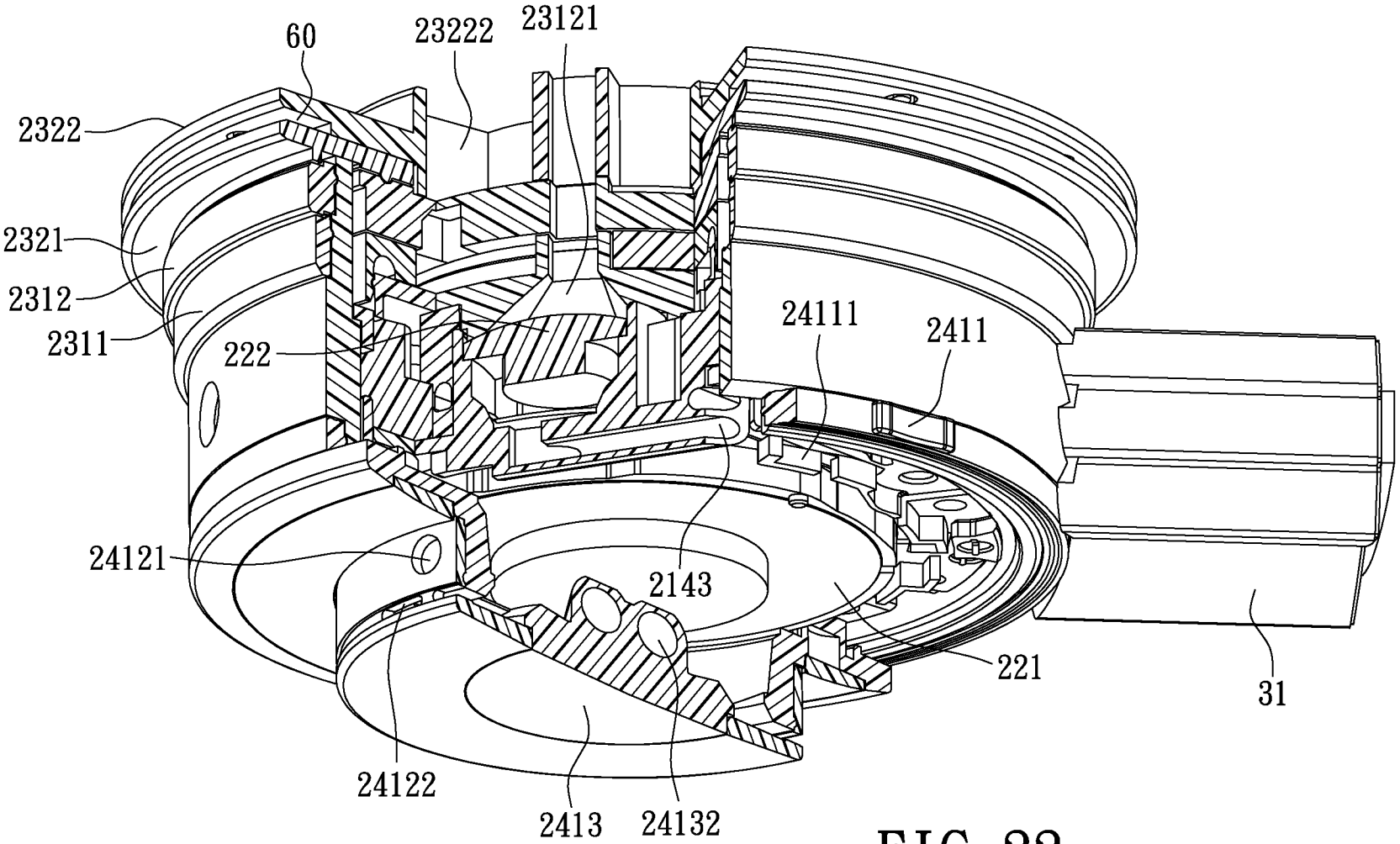
FIG. 22 illustrates a fifth cross-sectional view of a tunable multichannel headphone in accordance with one embodiment of the instant disclosure.

When the first timbre switch 2411 rotates along the central axis CA, the shields 24111 are brought together to open/close the secondary sound ducts 2143 (as shown in FIGS. 21 and 22). For example, if the first timbre switch 2411 has two legs, when the first timbre switch 2411 goes along a direction (for example, clockwise), the shield 24111 covers the corresponding duct opening 21431 (refer to FIG. 21), and the tone becomes more closed. In contrast, when the first timbre switch 2411 rotates in the opposite direction (i.e. anti-clockwise in the instant embodiment), the shield 24111 is removed from the duct opening 21431 (refer to FIG. 22), and the tone becomes more open.

Two sound outlets 24112 are formed opposite each other and proximate to the shields 24111 of the first timbre switch 2411. The first timbre switch 2411 has a sound passage 24113 which is annular shaped and in air communication with the sound outlets 24112.

Please refer to FIG. 9 in conjunction with FIG. 10. The timbre tuning unit 241 further includes a positioning disk 2413 screwed on the speaker disk 21 and flanked by the first and second timbre switches 2411, 2412.

The positioning disk 2413 is formed with a round recess 24131 in the centre with a plurality of first apertures 24133 and a plurality of timbre ducts 24132 with timbre duct openings 24137. The first apertures 24133 are proximate to the timbre ducts 24132. The sound travels through the timbre ducts 24132 and exits via the timbre duct openings 24137. The preferred quantity of the timbre ducts 24132 is two and the quantity thereof is not limited thereto. The timbre ducts 24132 are arranged parallel in the recess 24131.

The first timbre switch 2411 has two cover tabs 24114 which are symmetrically disposed. Each of the cover tabs 24114 has a magnet holder 24115 for receiving a magnet (not shown in the figure) on one side that faces backward to the spacer 214.

Please refer to FIG. 9 in conjunction with FIG. 10. The second timbre switch 2412 conformingly envelopes the recess 24131 of the positioning disk 2413. The second timbre switch 2412 preferably has two first air outlets 24121, four second air outlets 24122 and two cups 24123 which are disposed substantially symmetrically. The first air outlets 24121 are substantially rounded, while the second air outlets 24122 are substantially oval shaped. However, the shapes thereof are not limited thereto. The recess 24131 is also formed with two curved slots 24135 to receive the cups 24123. The second air outlets 24122 are formed further away from the positioning disk 2413.

Figure 19:
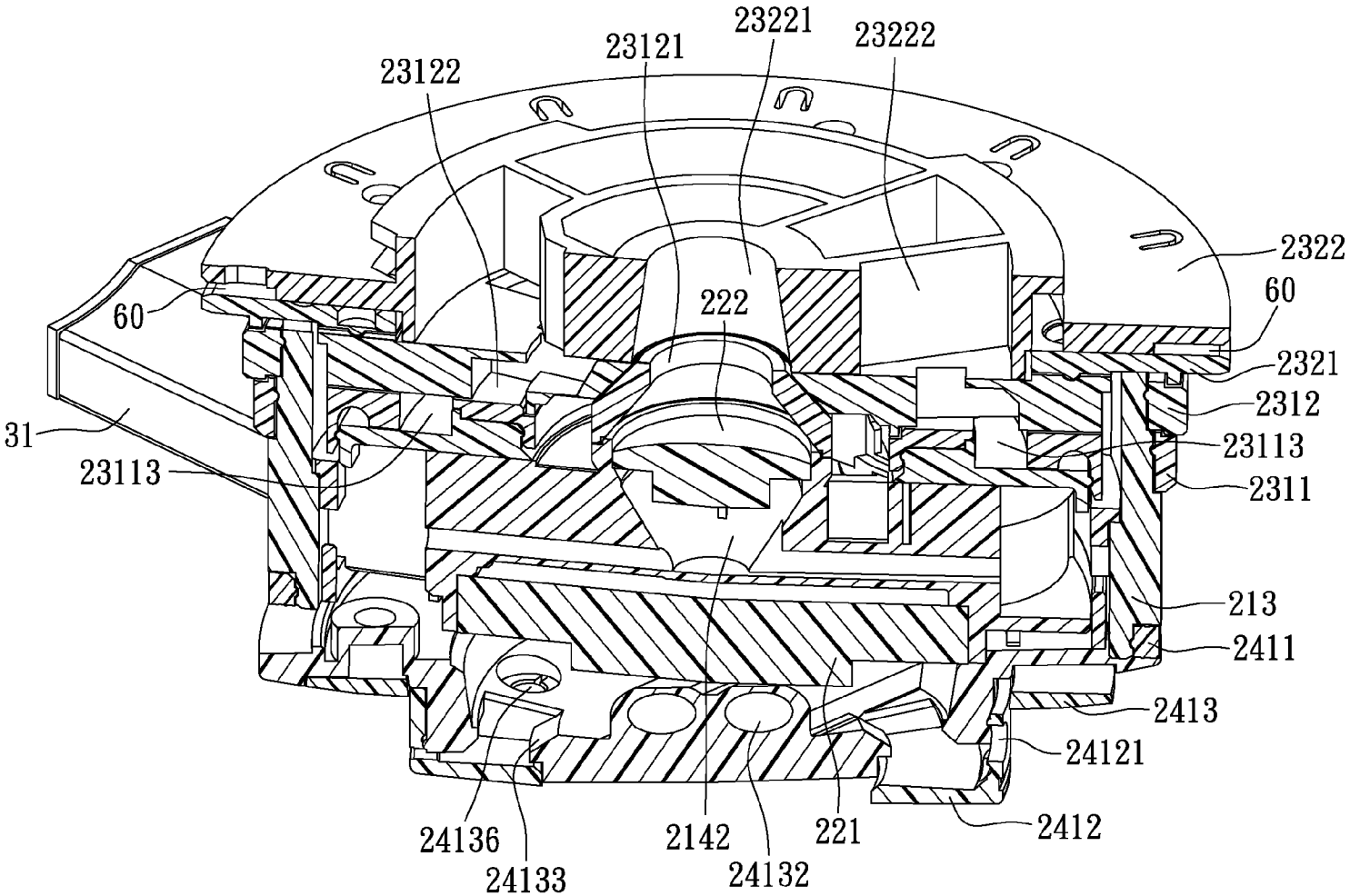
FIG. 19 illustrates a second cross-sectional view of a tunable multichannel headphone in accordance with one embodiment of the instant disclosure.
Figure 20:
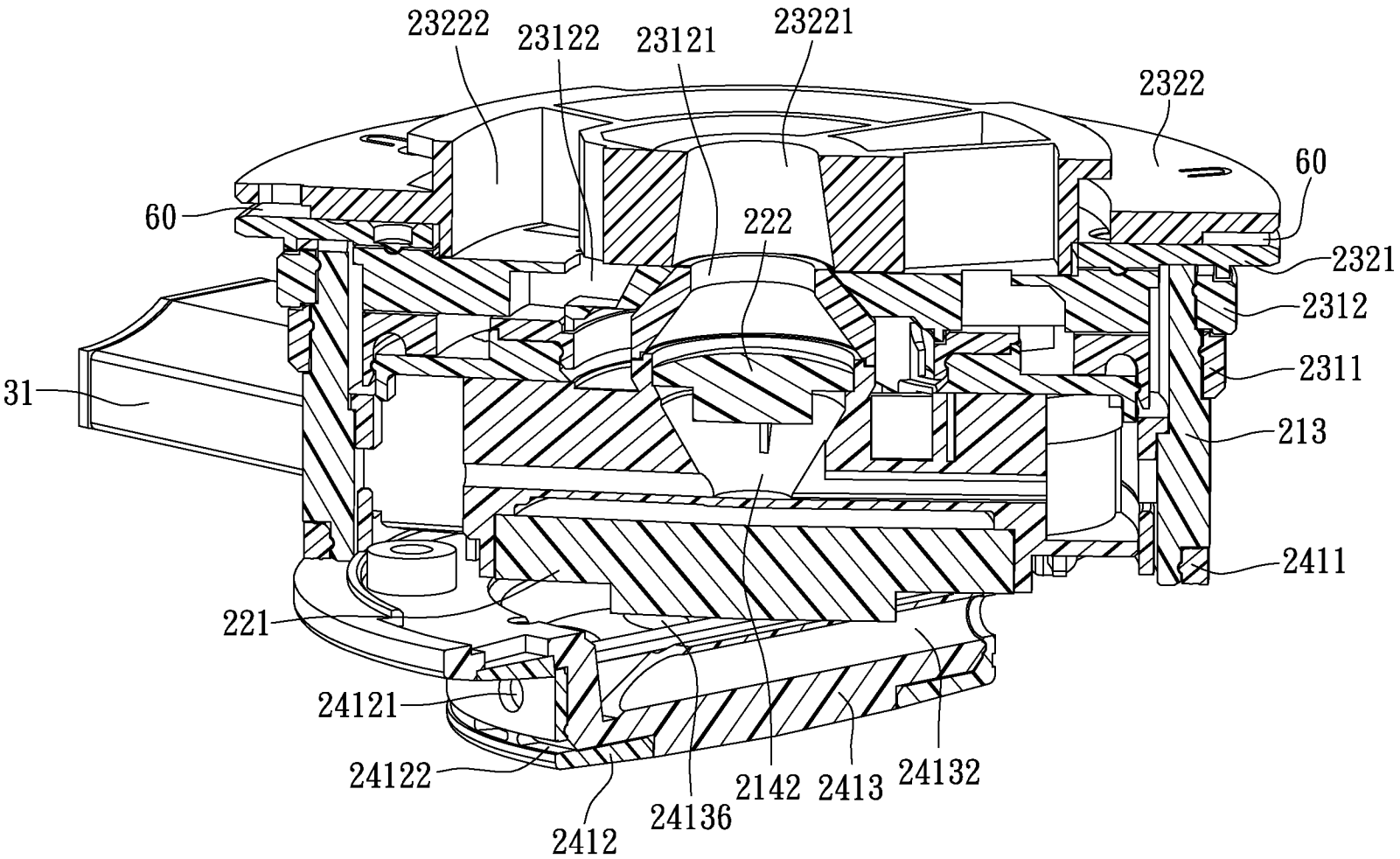
FIG. 20 illustrates a third cross-sectional view of a tunable multichannel headphone in accordance with one embodiment of the instant disclosure.

The sound travels through the timbre duct 24132 and passes the timbre duct opening 24137 which communicates with the first air outlet 24121 (refer to FIGS. 10 and 20). When switching to a different mode, the first aperture 24133 is in air communication with the second air outlet 24122 (refer to FIGS. 10 and 19).

The positioning disk 2413 has a plurality of magnet holders 24136 facing toward the first timbre switch 2411. The positioning disk 2413 preferably has six magnet holders 24136 annually and symmetrically disposed in the recess 24131. Each of the magnets in the magnet holders 24136 are arranged in a magnetic repulsion manner.

Additionally, the magnets disposed in the cups 24123 are magnetically attracted to the magnets disposed in the recess 24131.

It is worth to note that the first and second timbre switches 2411, 2412 are rotatable members. The first timbre switch 2411 has two timbre legs, whereas the second timbre switch 2412 has three tone legs. If the listener turns the first or second timbre switches 2411, 2412, the tone changes accordingly. Specifically, the timbre duct opening 24137 of the rear acoustic module 24 selectively opens or closes to direct the sound in the timbre duct 24132 and facilitate a different tone delivery. The structure of the front acoustic module 23 is further described in the following content.

Please refer to FIG. 3 in conjunction with FIG. 4. In the instant embodiment, the cap 211 includes five driver cups 2111. The driver cups 2111 connect the corresponding driver holders 2142 of the spacer 214 to form closed independent sound chambers accommodating secondary drivers 222. Each of the sound chambers in the speaker disk 21 is in a slightly different level. For example, in the instant embodiment, the primary and secondary drivers 221, 222 of the headphone 1 are arranged in three different layers. The primary driver 221 is at level one, four of the five secondary drivers 222 are at the second level, and the remaining one of the secondary driver 222 is at the third level. The four secondary drivers 222 at the second level are coplanar. However, the driver holders 2142 are adjustable to allow a minor level differentiation within the second level. That is to say the four secondary drivers 222 at the second level may slightly deviate from the plane.

Please refer to FIG. 7. The cap 211 is formed with an annular cap slit 2112. The cap slit 2112 is proximate to an annular wall 2113. A plurality of curved slots 21131 is formed on the annular wall 2113. Each of the curved slots 21131 is formed with a through hole 21132 penetrating the cap 211. The cap 211 has two tunnels 2114 disposed symmetrically along the outer edge of the annular wall 2113. The quantity of the through holes 21132 and the tunnels 2114 can vary.

The cap 211 has ten magnet holders 2115 disposed along the cap slit 2112. The magnet holders 2115 are arranged symmetrically, and the magnets therein are arranged in a magnetic repulsive manner.

Figure 11:
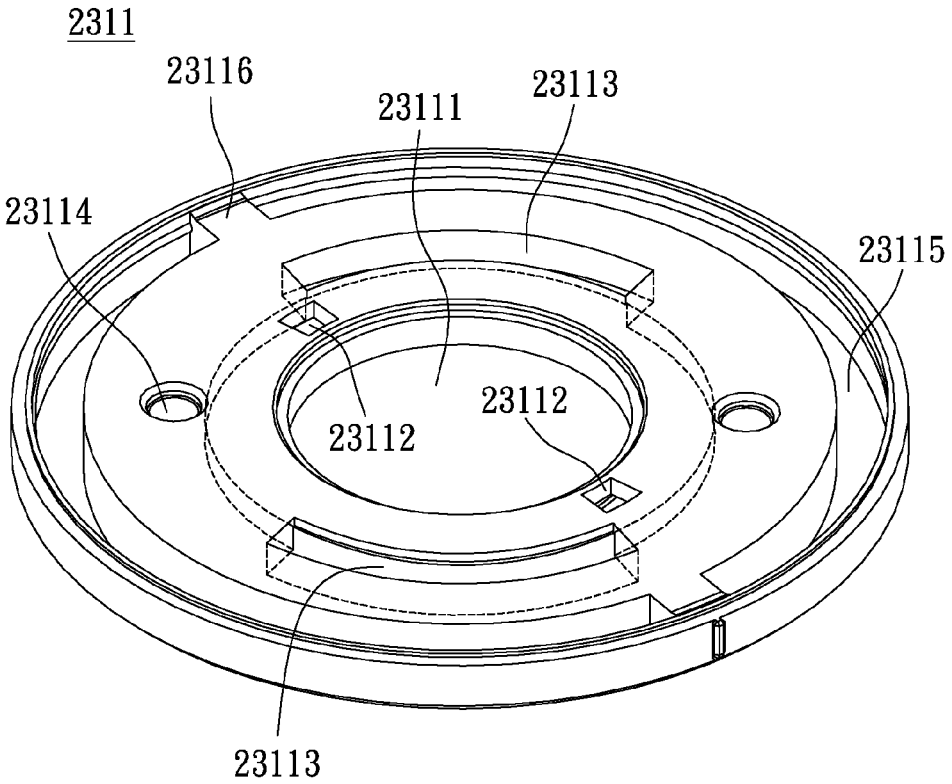
FIG. 11 illustrates a perspective view of a channel switch of a tunable multichannel headphone in accordance with one embodiment of the instant disclosure.
Figure 12:
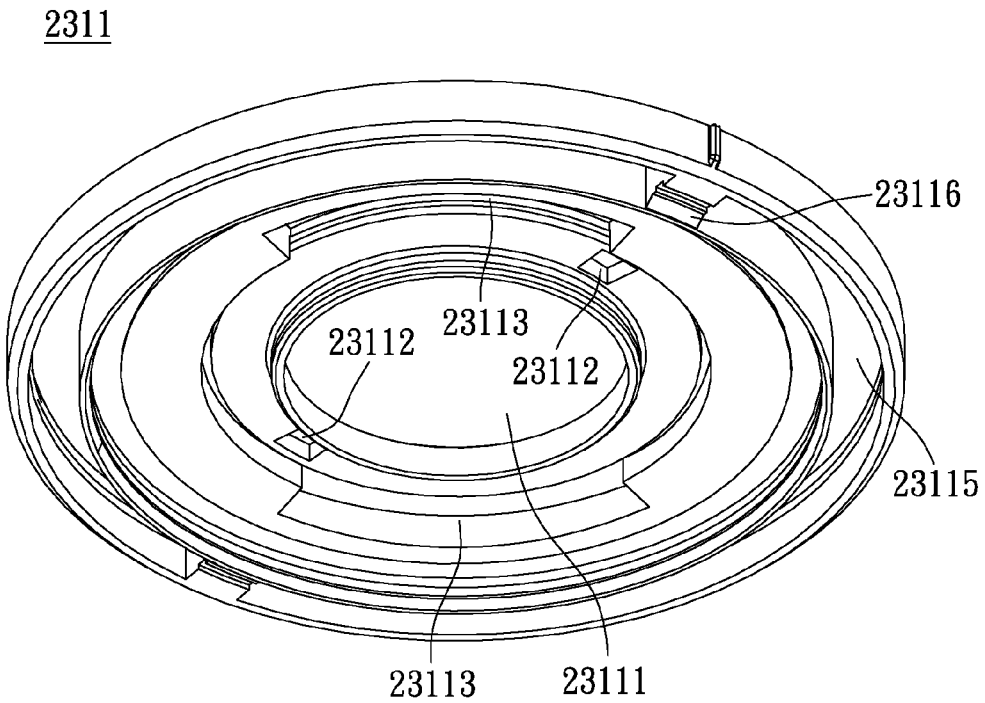
FIG. 12 illustrates a perspective view of a channel switch of a tunable multichannel headphone from another angle in accordance with one embodiment of the instant disclosure.

Please refer to FIGS. 7, 11 and 12. The channel switch 2311 has a channel outlet 23111 communicating with the cap slit 2112. A plurality of channel output apertures 23112 and a plurality of curved channel output slits 23113 are symmetrically formed on the channel switch 2311 and concentric to the channel outlet 23111. The channel output apertures 23112 conform to the curved slots 21131 of the cap 211 and are in air communication with the through holes 21132. On the other hand, the channel output slits 23113 are in air communication with the tunnel 2114.

Specifically, for different channel systems, rotating (for example clockwise) the channel switch 2311 alone splits the channel information to different systems. In other words, turning the channel switch 2311 is tuning for different channel systems (for example, 5.1, 7.1 and 9.1 channel systems).

Figure 13:
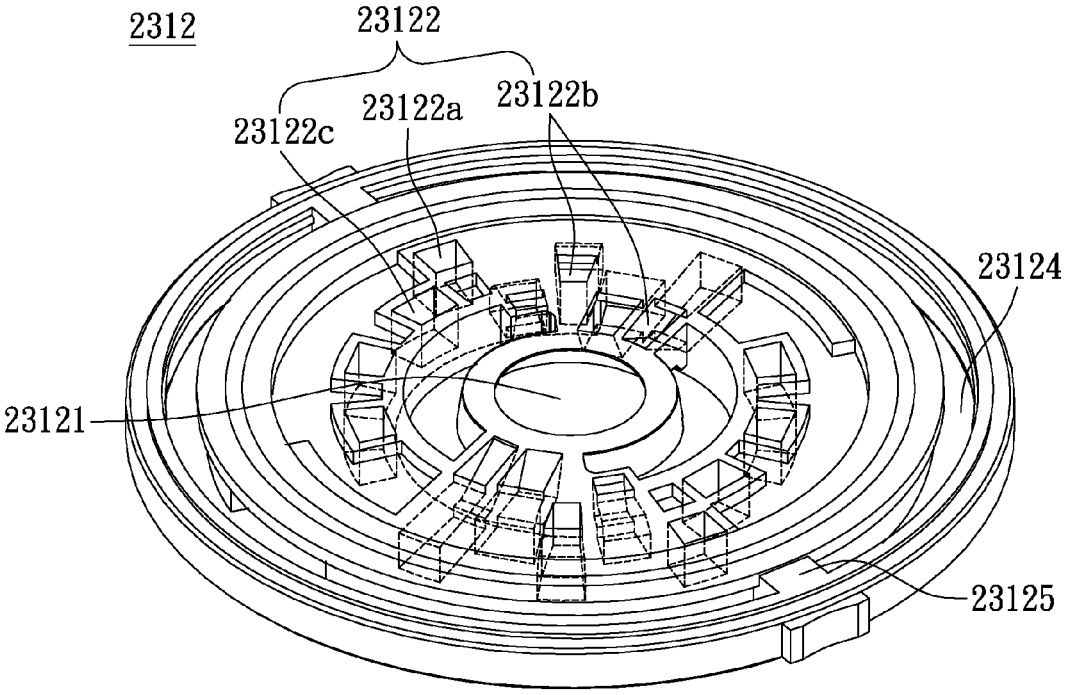
FIG. 13 illustrates a perspective view of a field switch of a tunable multichannel headphone in accordance with one embodiment of the instant disclosure.
Figure 14:
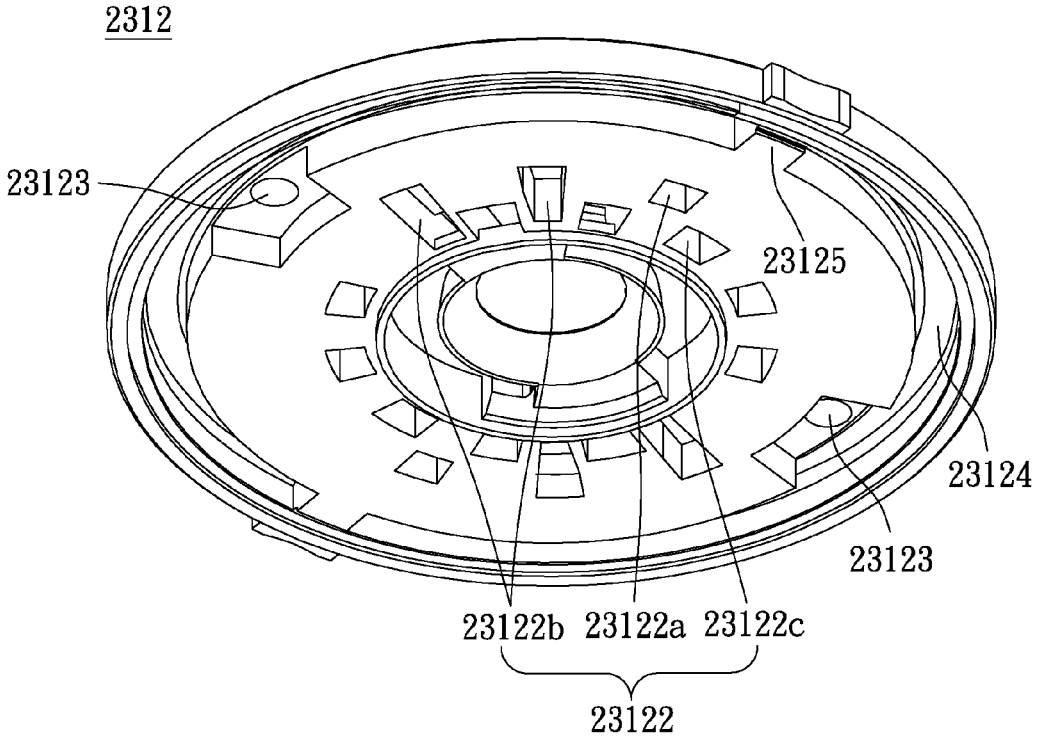
FIG. 14 illustrates a perspective view of a field switch of a tunable multichannel headphone from another angle in accordance with one embodiment of the instant disclosure.

Please refer to FIGS. 7, 13 and 14. In the instant embodiment, the field switch 2312 is formed with a field outlet 23121 penetrating the centre portion thereof and a plurality of sound field apertures 23122. The quantity of the field outlets 23122 can vary for desired sound effects.

The field apertures 23122 are radially formed along the field outlet 23121 and are selectively in air communication with the channel output apertures 23112 as well as the channel output slits 23113. Specifically, the field switch 2312 is also formed with a plurality of rectangular field apertures 23122*a* and a plurality of tunnel-shaped field apertures 23122*b* all surrounding the field outlet 23121.

Please refer to FIG. 7 in conjunction with FIG. 8. The audio output unit 232 of the front acoustic module 23 includes a positioning disk 2321. The annular positioning disk 2321 is formed with a positioning hole 23211 in air communication with the field outlet 23121 and the field apertures 23122 of the field switch 2312. The positioning disk 2321 preferably has ten magnet holders 23212 proximate to the positioning hole 23211. The magnet holders 23212 are disposed symmetrically, and the magnets accommodated therein are arranged in a magnetic repulsive manner.

Please refer to FIGS. 7, 8, 13 and 14. One side of the field switch 2312 facing the channel switch 2311 has two symmetrically disposed magnet holders 23123 at the periphery thereof. The magnets accommodated in the magnet holders 23123 and 23212 are magnetically attractive to each other.

Figure 15:
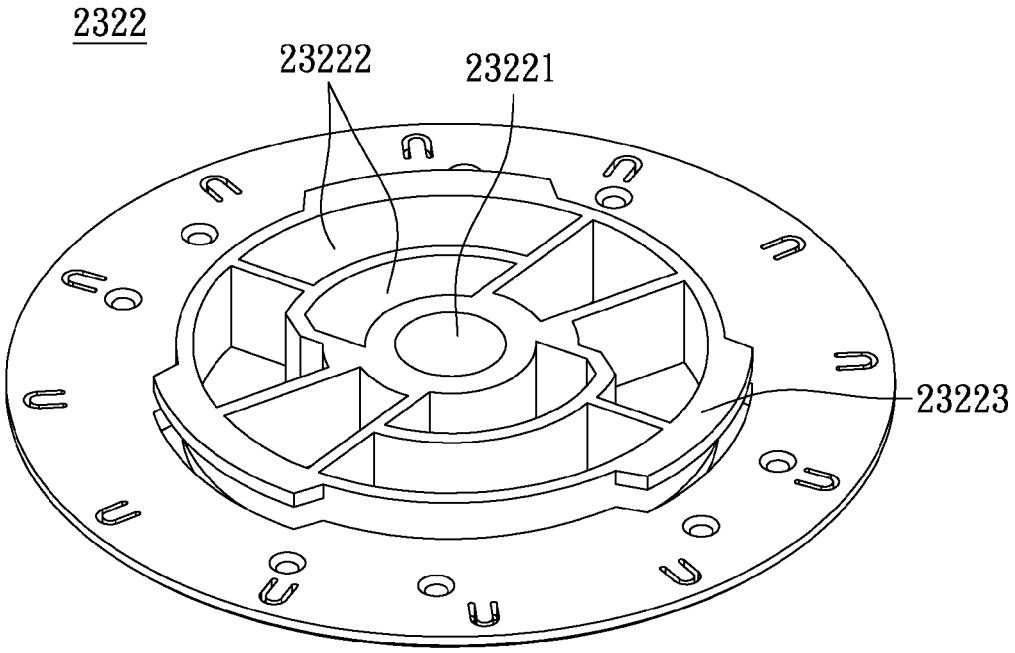
FIG. 15 illustrates a perspective view of an audio output disk of a tunable multichannel headphone in accordance with one embodiment of the instant disclosure.
Figure 16:
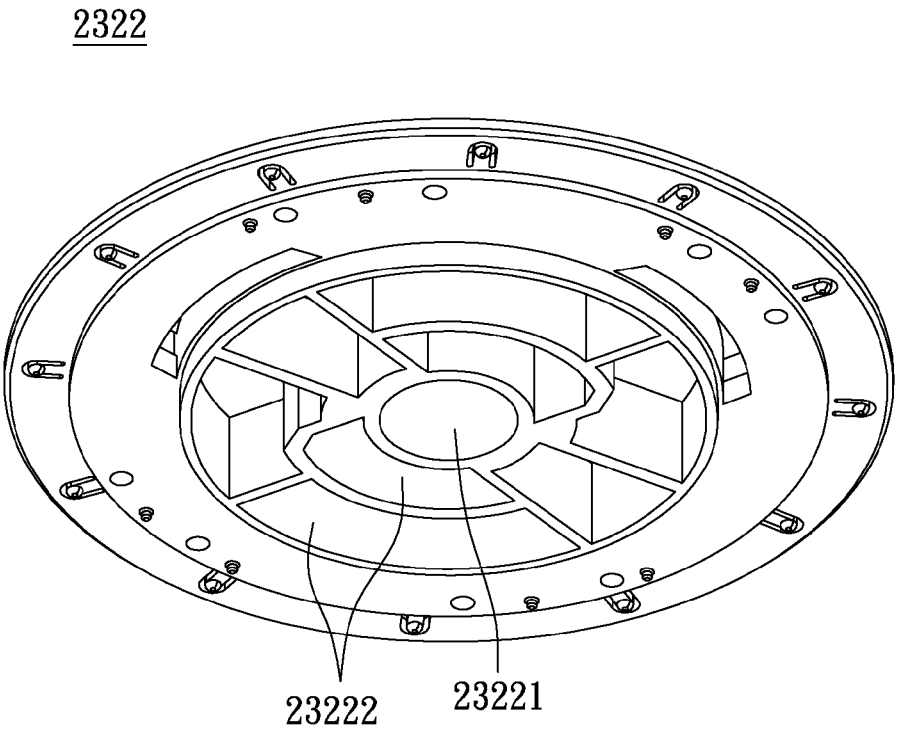
FIG. 16 illustrates a perspective view of an audio output disk of a tunable multichannel headphone from another view point in accordance with one embodiment of the instant disclosure.

Please refer to FIGS. 7, 15 and 16. In the instant embodiment, the audio output unit 232 of the front acoustic module 23 further has an audio output disk 2322. The audio output disk 2322 is formed with an audio outlet 23221 and a plurality of audio output apertures 23222. The audio output apertures 23222 are arranged radially yet alternatively from the audio outlet 23221. The audio outlet 23221 and the audio output apertures 23222 are in air communication with the positioning hole 23211 of the positioning disk 2321. The audio output apertures 23222 also selectively communicate with the channel output apertures 23112 and channel output slits 23113. The channel and field switching are further described below.

Please refer to FIGS. 3, 13 and 14. When adjusting the channel switch 2311 (for example, 5.1, 7.1 and 9.1 channel systems) and the field switch 2312 (for example, large, medium and small fields), different fields and channel systems provide a variety of sound effects.

Take 5.1 channel system and large field for example.

When the listener tunes to the 5.1 channel system and the large field, the primary driver 221 delivers the wave along the central axis CA toward a direction opposite to the spacer 214, whereas the secondary drivers 222 deliver the sound through two routes. Only the associated apertures are opened, and the rest apertures are blocked. For example, one of the two routes is from the cap 211 to the tunnel 2114 and through the channel output slit 23113 of the channel switch 2311. The sound further travels through the field apertures 23122*a* and 23122*b* to the positioning hole 23211 of the positioning disk 2321 and finally enters the listener's ears via the audio output apertures 23222 of the audio output disk 2322.

The other route for the sound delivered by the secondary drivers 222 goes from the through hole 21132 of the cap 211 to the channel output aperture 23112. Then, the sound travels through the field apertures 23122*c* and the positioning hole 23211. Finally the sound reaches the listener's ear canal via the audio output aperture 23222.

Figure 17:
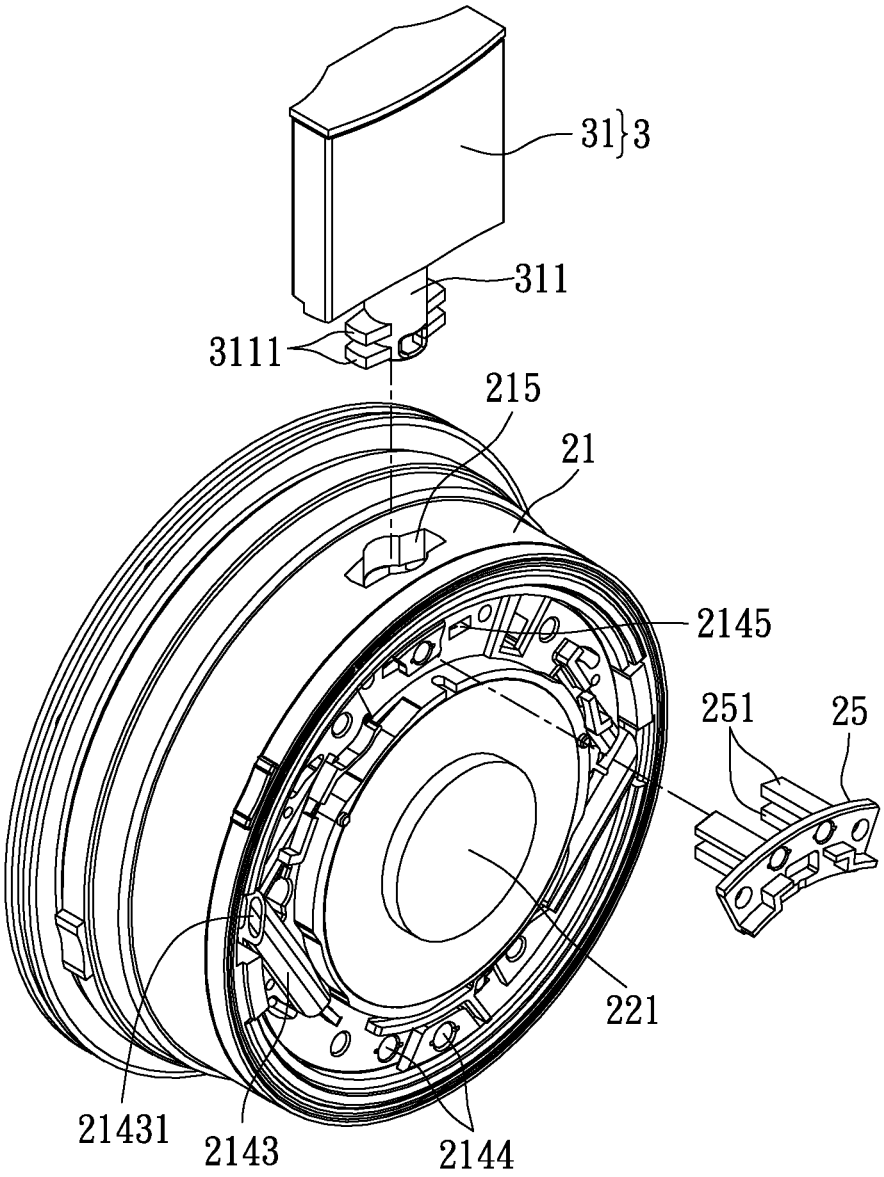
FIG. 17 illustrates a perspective view of a connection unit of a tunable multichannel headphone before assembling in accordance with one embodiment of the instant disclosure.

Please refer to FIGS. 1, 3 and 17. The connection unit 3 further includes a connector 31 with an extension 311. The connector 31 connects the tail of the connection unit 3. The extension 311 is inserted into a locking hole 215 of the speaker disk 21. Four positioning tabs 3111 laterally project from the extension 311.

The main housing 2 further includes a fastening member 25. The extension 311 fits into the locking hole 215, and the fastening member 25 abuts the positioning tabs 3111 by the fastening tabs 251. The spacer 214 has a plurality of engagement grooves 2145 receiving the fastening tabs 251 which extend along the central axis CA. When the extension 311 engages with the locking hole 215, the fastening tabs 251 pass through the engagement grooves 2145 and are locked by the positioning tabs 3111 to secure the connector 31. Alternatively, the connector 31 can be screwed to the speaker disk 21.

Figure 25:
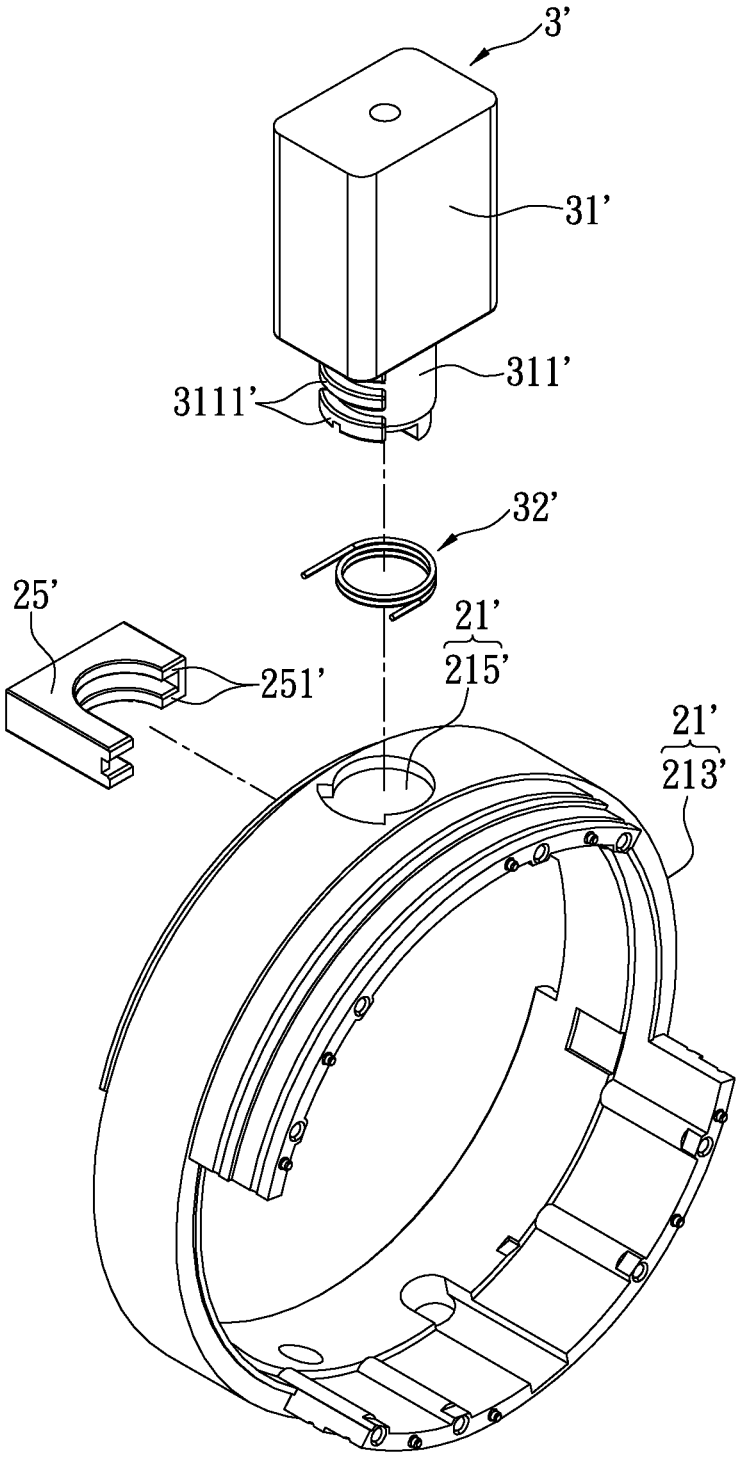
FIG. 25 illustrates a perspective view of a connection unit of a tunable multichannel headphone before assembling in accordance with one embodiment of the instant disclosure.

Please refer to FIG. 1 in conjunction with FIG. 25. In another embodiment, the extension 311' is cylinder shaped, and the locking hole 215' formed in the outer ring 213' of the speaker disk 21' is conforming thereto. As the extension 311' is inserted to the locking hole 215', the fastening tabs 251' clamp the rounded positioning tabs 3111' to secure the connector 31'. In other words, the fastening tabs 251' of the fastening member 25' and the positioning tabs 3111' alternatively overlap, thus tightly engaging the connector 31'.

In addition, the connection unit 3' further includes an elastic member 32' enveloping the extension 311' and a power switch arranged proximate to the extension 311' (not shown in the figure). When the listener turns the connector 31' (for example, clockwise), the slanting face (not shown in the figure) of the extension 311' contacts and switches on the power switch of the headphone 1. In contrast, if turning anti-clockwise, the slanting face is removed from the power switch, and the headphone 1 is power off. The elastic member 32' can be a spring.

Figure 18:
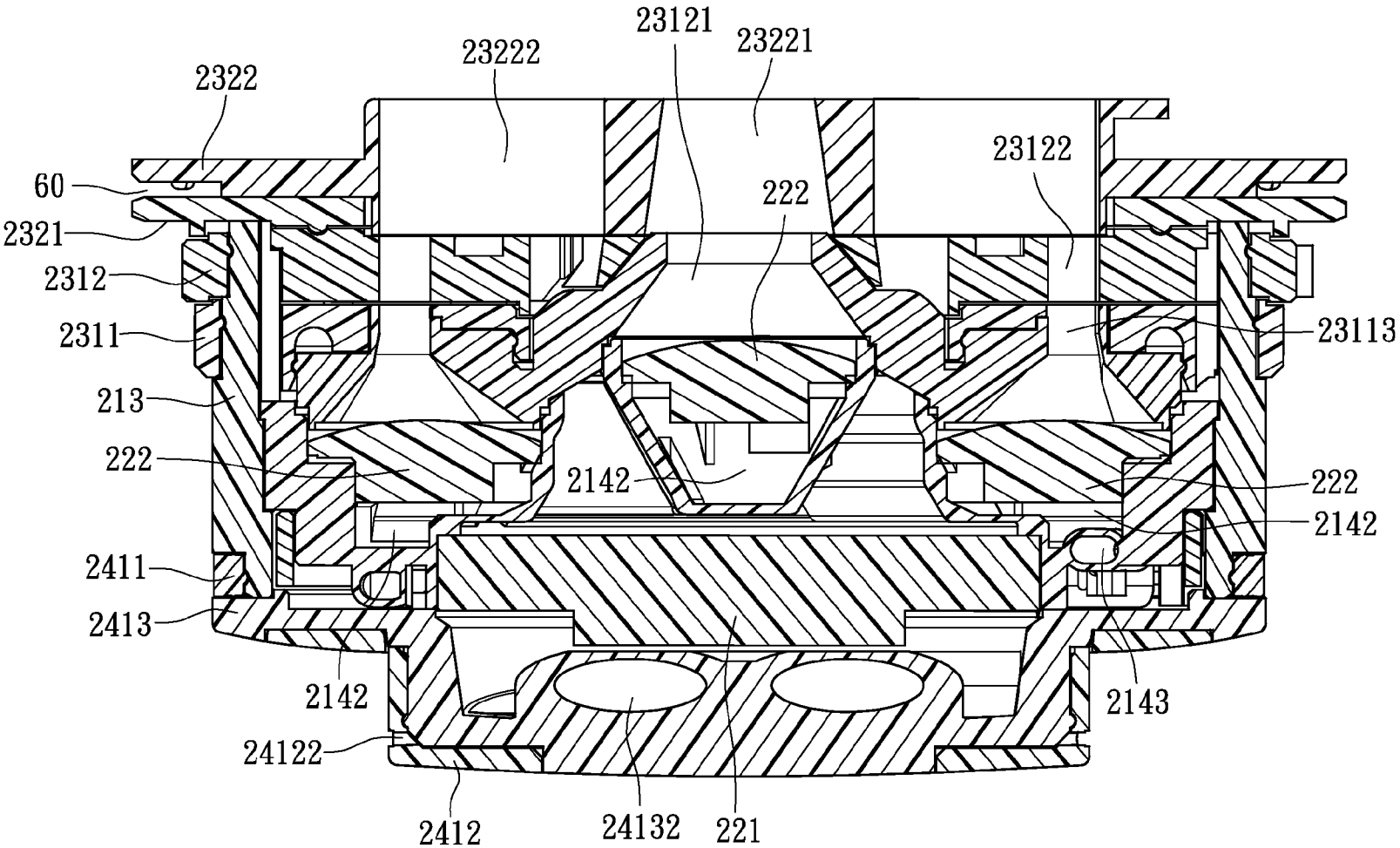
FIG. 18 illustrates a first cross-sectional view of a tunable multichannel headphone in accordance with one embodiment of the instant disclosure.

Please refer to FIGS. 3, 4 and 18. Each of the secondary drivers 222 is fittingly and separately received by the driver holders 2142. The secondary drivers 222 lodge into independent enclosures in the main housing 2 to effectively discriminate different fields. By adjusting the field switch 2312, the listener has a distinct sonic performance.

Figure 23:
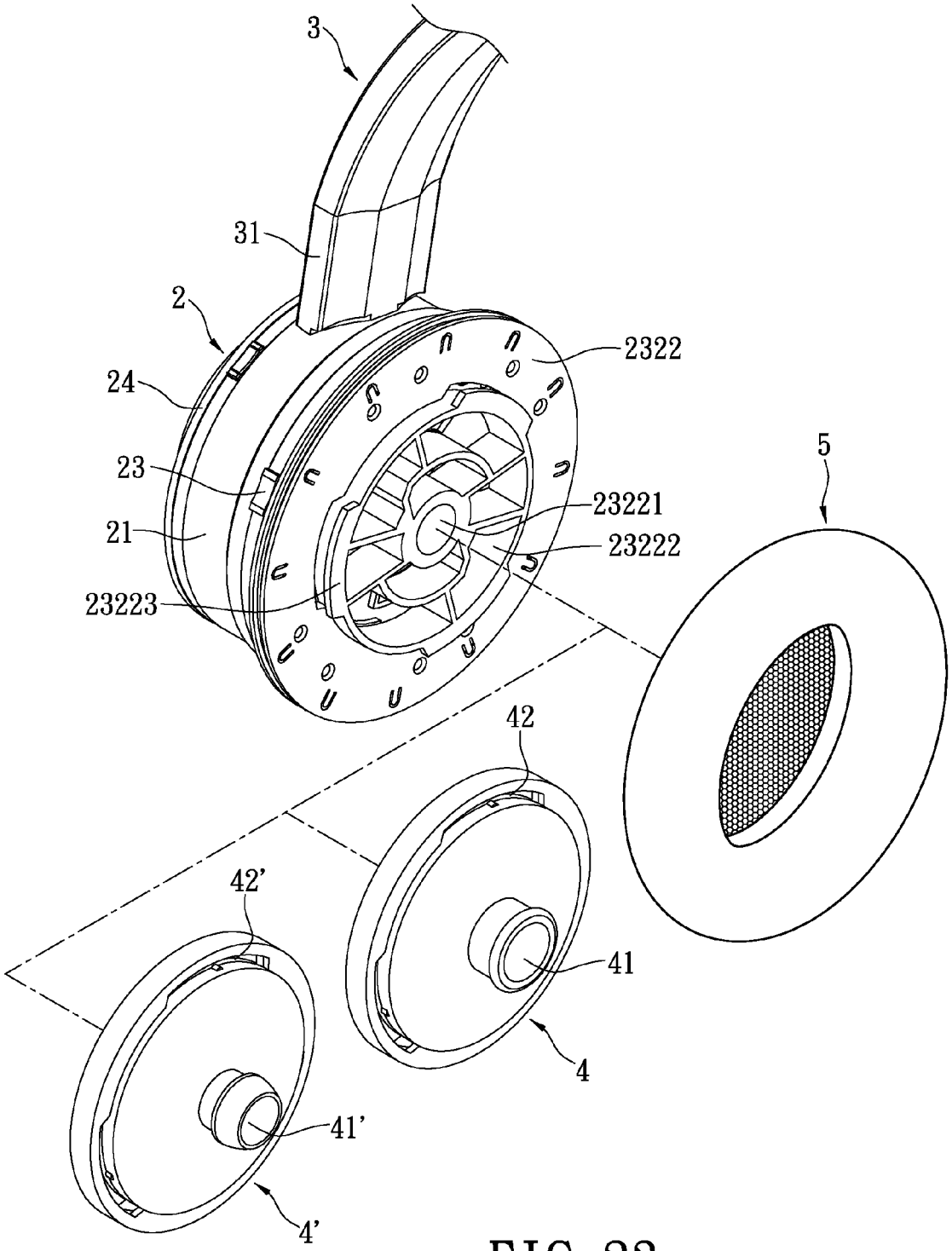
FIG. 23 illustrates a schematic diagram of a tunable multichannel headphone with ear pads and a sound funnel in accordance with one embodiment of the instant disclosure.

Please refer to FIG. 3 in conjunction with FIG. 23. The headphone 1 further comprises a sound funnel 4 and an ear pad 5. The audio output disk 2322 includes at least one wing 23223. The ear pad 5 can be made of sponge, and the material thereof is not limited thereto. A gap 60 (please refer to FIG. 18) is formed between the positioning disk 2321 and the audio output disk 2322. The annular ear pad 5 clamps on the gap 60 while not interfering with the switching of the disk members. That is to say, the ear pad 5 is securely engaged between the positioning disk 2321 and the audio output disk 2322. The positioning disk 2321, and the audio output disk 2322 are made of plastic, and the material thereof is not limited thereto.

The ear pad 5 can surround the audio output disk 2322 alone or sandwiches the sound funnel 4 there-between. The sound funnel 4 is formed with at least one slit 42, and the slit 42 receives the wings 23223 of the audio output disk 2322. The sound funnel 4 is a thin shell with a protrusion 41 which serves as an ear plug. When the sound funnel 4 is detachably assembled to the audio output disk 2322, the protrusion 41, which prevents sound leakage and noise intrusion, guides the sound from the driver unit 22 to the listener's ear canal for an enhanced sound wave.

The instant disclosure may also comprise another sound funnel 4', and the difference arises from the protrusion 41' which is an in-ear plug to tightly seal the sound delivery path. The sound funnel 4' can also use the slit 42' to engage with the wing 23223. Specifically, the sound funnels 4, 4' and the ear pad 5 can be replaced for different listening requirements.

Figure 24:
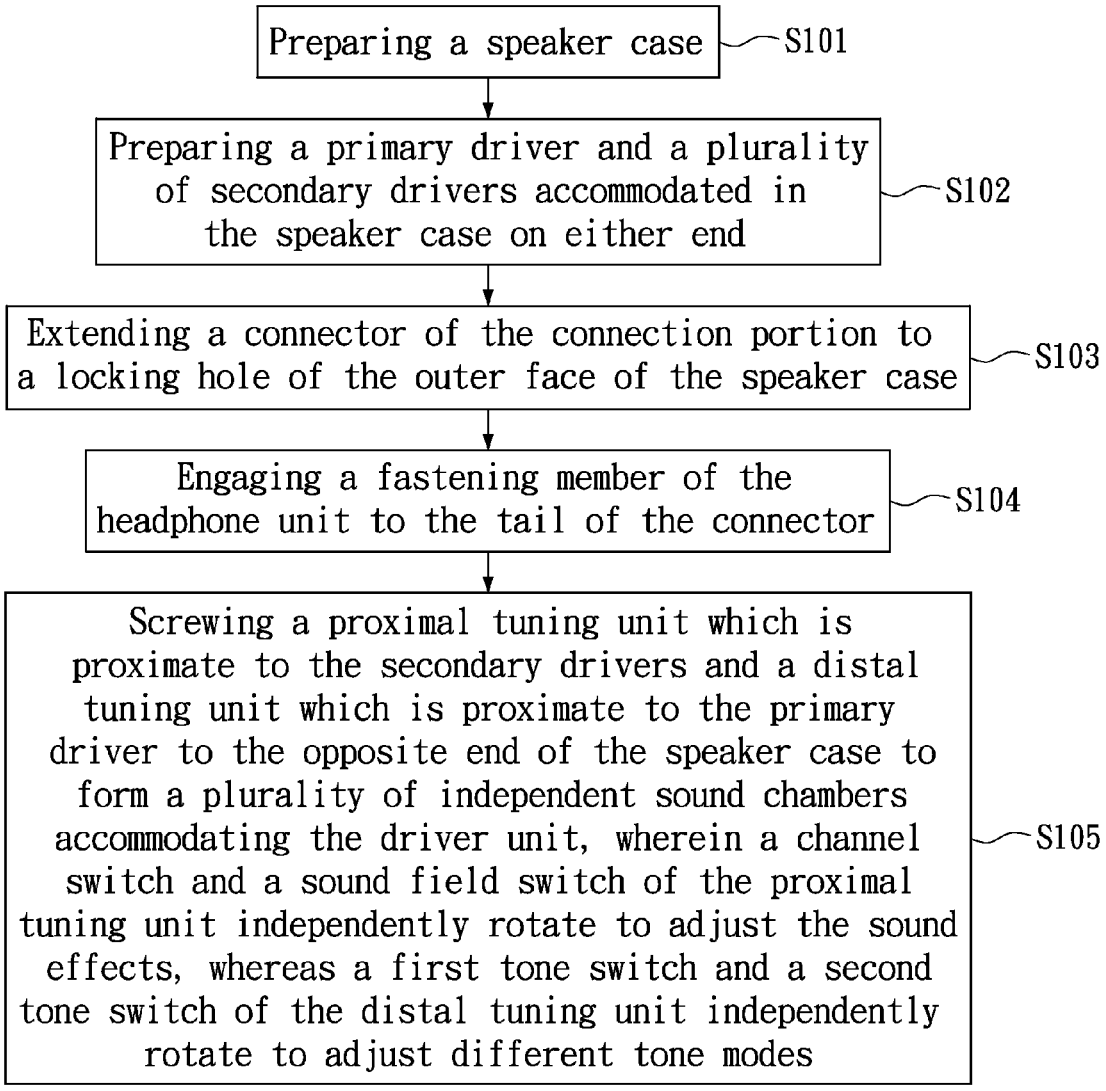
FIG. 24 shows a flow chart of a method for assembling a tunable multichannel headphone in accordance with the instant disclosure.

Please refer to FIG. 24 in conjunction with FIG. 3. The instant disclosure provides a method for assembling a tunable multichannel headphone. The two main housings 2 connect to the connection unit 3 respectively, with the assembly of one of the main housing 2 comprising:

S101: Preparing a speaker disk 21.

S102: Preparing a primary driver 221 and a plurality of secondary drivers 222 accommodated in the speaker disk 21 on either end respectively.

S103: Extending a connector 31 of a connection unit 3 to a locking hole 215 of the speaker disk 21.

S104: Engaging a fastening member 25 of the main housing 2 to the tail of the connector 31.

S105: Engaging by screws of a front acoustic module 23 which is close to the secondary drivers 222 and a rear acoustic module 24 which is close to the primary driver 221 to the opposite end of the main housing 2 to form a plurality of independent sound chambers for receiving the driver unit 22.

Specifically, a channel switch 2311 and a field switch 2312 of the front acoustic module 23 are able to independently rotate along the central axis CA of the speaker disk 21 to adjust the sound effects.

In addition, a first timbre switch 2411 and a second timbre switch 2412 of the rear acoustic module 24 are also able to independently rotate along the central axis CA of the speaker disk 21 to adjust different timbres.

The instant disclosure provides the tunable multichannel headphone and the method for assembling the same. The proximal and rear acoustic modules are disposed on opposite ends of the main housing to form the plurality of independent sound chambers for receiving the driver unit and enhancing the clarity and power of the sound wave.

Additionally, the channel switch, the field switch, and the first and second timbre switches are rotatable switches to change among distinct channels, fields and tones.

Furthermore, the intricate audio current path leads to different channel systems (for example, 2.1, 5.1, 7.1 and 9.1 channel systems) to provide a complex sound propagation.

Moreover, the flexible switches allow different combinations of independent sound chambers, therefore simulating a virtual four-dimensional space with a rich and lossless audio quality.

The descriptions illustrated supra set forth simply the preferred embodiments of the instant disclosure. However, the characteristics of the instant disclosure are by no means restricted thereto. All changes, alternations, or modifications conveniently considered by those skilled in the art are deemed to be encompassed within the scope of the instant disclosure delineated by the following claims

What is claimed is:

1. A tunable multichannel headphone comprising:

at least one main housing comprising:

a speaker disk including:

a cap formed with an annular cap slit, an annular wall proximate to the annular cap slit, a plurality of curved slots formed on the annular wall, and a plurality of tunnels disposed symmetrically along an outer edge of the annular wall, with each curved slot of the cap formed with a through hole penetrating the cap;

an outer ring surrounding the cap;

a spacer surrounded by the outer ring and having a plurality of secondary sound ducts, with each secondary sound duct having a duct opening; and a plurality of independent sound chambers defined in the speaker disk;

a set of driver units including a primary driver and a plurality of secondary drivers, with the primary driver and the plurality of secondary drivers respectively disposed in the plurality of independent sound chambers of the speaker disk;

wherein the duct openings of the plurality of secondary sound ducts respectively face toward the primary driver and the plurality of secondary drivers;

a front acoustic module including a sound effect tuning unit and an audio output unit, with the sound effect tuning unit and the audio output unit on the cap opposite the plurality of secondary drivers, with the sound effect tuning unit including a channel switch and a field switch both individually rotatable around a central axis of the speaker disk;

wherein the channel switch has a channel outlet, a plurality of channel output apertures, and a plurality of second channel output slits, wherein the plurality of channel output apertures and the plurality of second channel output slits are symmetrically formed on the channel switch and are arranged around and concentric to the channel outlet, wherein air is communicable from the plurality of tunnels of the cap to the plurality of second channel output slits, from the plurality of curved slots of the cap and the through holes of the plurality of curved slots to the plurality of channel output apertures, and from the annular cap slit to the channel outlet for respectively tuning multiple channel systems when the channel switch is rotated; and a rear acoustic module coupled to the speaker disk opposite the front acoustic module, with the rear acoustic module including a timbre tuning unit, with the timbre tuning unit having a first timbre switch and a second timbre switch both rotatable around the central axis of the speaker disk;

wherein the first timbre switch is annular and has a sound passage being annular, a plurality of shields, and a plurality of sound outlets, with the plurality of sound outlets in air communication with the sound passage, wherein the plurality of shields selectively cover or are removed from the duct openings of the plurality of secondary sound ducts; and wherein when the first timbre switch is rotated, the plurality of shields of the first timbre switch selectively open or close the plurality of secondary sound ducts.

2. The tunable multichannel headphone according to claim 1, wherein the at least one main housing comprises at least two main housings connected via at least one connection portion.

3. The tunable multichannel headphone according to claim 2, wherein each of the at least one connection portion further includes two connectors, wherein each of the at least two the main housings further includes a fastening member, the two connectors are at a tail end of the at least one connection portion, wherein the speaker disk is formed with a locking hole, wherein each of the two connectors has an extension with a plurality of positioning tabs symmetrically arranged on the extension, wherein the extension is inserted into the locking hole of the speaker disk of a corresponding one of the at least two main housings, and wherein the plurality of positioning tabs of the extension of each of the two connectors alternatively engage with a plurality of fastening tabs of the fastening member of the corresponding one of the at least two main housings.

4. The tunable multichannel headphone according to claim 1, wherein the spacer is formed with an opening and a plurality of driver holders, and wherein the primary driver is fittingly received by the opening while the plurality of secondary drivers are respectively disposed in the plurality of driver holders.

5. The tunable multichannel headphone according to claim 4, wherein the plurality of sound outlets is proximate to the plurality of shields respectively.

6. The tunable multichannel headphone according to claim 4, wherein the cap includes a plurality of driver cups connecting with the plurality of driver holders of the spacer respectively to close the plurality of independent sound chambers, and wherein the plurality of sound chambers is arranged at various levels.

7. The tunable multichannel headphone according to claim 1, wherein the timbre tuning unit further includes a positioning disk screwed on the speaker disk and flanked by the first and second timbre switches, wherein the positioning disk of the timbre tuning unit is formed with a substantially round recess, a plurality of timbre ducts and a plurality of first apertures, with the plurality of timbre ducts arranged in parallel in the round recess and radially extend on the positioning disk, with the plurality of first apertures disposed in the round recess and proximate to the plurality of timbre ducts, and wherein a plurality of cover tabs is symmetrically arranged on the first timbre switch.

8. The tunable multichannel headphone according to claim 7, wherein the second timbre switch is stacked on the positioning disk of the timbre tuning unit, wherein the second timbre switch has a plurality of first air outlets and a plurality of second air outlets, wherein the plurality of first air outlets and the plurality of second air outlets penetrate an edge of the second timbre switch, wherein the plurality of timbre ducts communicate with the plurality of first air outlets while the plurality of first apertures communicate with the plurality of second air outlets, wherein the positioning disk of the timbre tuning unit has a plurality of annular slots facing toward the second timbre switch, and wherein the second timbre switch has a plurality of cups conformingly fit into the plurality of annular slots of the positioning disk of the timbre tuning unit.

9. The tunable multichannel headphone according to claim 1, wherein the channel outlet of the channel switch corresponds to the annular cap slit, wherein the plurality of channel output apertures communicate with the plurality of curved slots and the through holes of the cap, and wherein the plurality of second channel output slits communicate with the plurality of tunnels.

10. The tunable multichannel headphone according to claim 9, wherein the field switch is formed with a field outlet and a plurality of field apertures, wherein the plurality of field apertures are radially arranged around the field outlet and selectively communicate with the plurality of channel output apertures and the plurality of second channel output slits.

11. The tunable multichannel headphone according to claim 10, wherein the audio output unit includes a positioning disk formed with a positioning hole communicating with the field outlet and the plurality of field apertures.

12. The tunable multichannel headphone according to claim 11, wherein the audio output unit includes an audio output disk formed with an audio outlet and a plurality of audio output apertures, wherein the plurality of audio output apertures radially surround the audio outlet, wherein the audio outlet and the plurality of audio output apertures communicate with the positioning hole of the positioning disk of the audio output unit, and wherein the plurality of audio output apertures selectively communicate with the plurality of channel output apertures and the plurality of second channel output slits.

13. The tunable multichannel headphone according to claim 12, further comprising at least one sound funnel, wherein each of the at least one sound funnel includes a protrusion projecting from a centre portion of the sound funnel, and at least one ear pad being a pot-like structure enveloping the audio output disk.

14. A method for assembling a main housing of a tunable multichannel headphone, comprising:

preparing a speaker disk;

preparing a primary driver and a plurality of secondary drivers accommodated in the speaker disk on either end of the speaker disk respectively;

extending a connector of a connection portion to a locking hole of the speaker disk;

engaging a fastening member of the main housing to a tail end of the connector; and engaging by screws of a front acoustic module which is close to the plurality of secondary drivers and a rear acoustic module which is close to the primary driver to opposite ends of the main housing to form a plurality of independent sound chambers for receiving the primary driver and the plurality of secondary drivers, wherein a channel switch and a field switch of the front acoustic module independently rotate for switching to different channel systems and different sound fields respectively, whereas a first timbre switch and a second timbre switch of the rear acoustic module independently rotate for switching to different tones.

* * * * *